US007214633B2

(12) United States Patent
Sun et al.

(10) Patent No.: US 7,214,633 B2
(45) **Date of Patent: *May 8, 2007**

(54) POLYVINYLAMINE TREATMENTS TO IMPROVE DYEING OF CELLULOSIC MATERIALS

(75) Inventors: Tong Sun, Neenah, WI (US); Jeff Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 564 days.

This patent is subject to a terminal disclaimer.

(21) Appl. No.: 10/022,823

(22) Filed: Dec. 18, 2001

(65) Prior Publication Data

US 2003/0135939 A1 Jul. 24, 2003

(51) Int. Cl.
*B32B 5/02* (2006.01)

(52) U.S. Cl. ..... 442/59; 442/152; 442/155; 442/157; 442/160; 428/195.1

(58) Field of Classification Search ..... 442/59, 442/152, 155, 157, 160; 428/195.1
See application file for complete search history.

(56) References Cited

U.S. PATENT DOCUMENTS 3,728,214 A 4/1973 Espy
6,315,824 B1 11/2001 Lauzon

FOREIGN PATENT DOCUMENTS

DE 3926059 A1 2/1991
EP 0606889 B1 7/1994
GB 1040036 8/1966
JP 02127593 A * 5/1990
WO WO 0194688 A1 12/2001

OTHER PUBLICATIONS

PCT Search Report Feb. 9, 2004.
Article—*Tailor-made performance profiles for the flexible structure of polyvinylamines*, A. W. Stange and W. J. Auhorn, Wochenblatt Für Papierfabrikation 8, 1999, pp. 511-518.
Article—*N-Vinylformamide—Synthesis and Chemistry of a Multifunctional Monomer*, Michael Kröner, Jacques Dupuis, and Manfred Winter, J. Prakt. Chem., vol. 342, No. 2, 2000, pp. 115-131.

* cited by examiner

*Primary Examiner*—Elizabeth M. Cole
(74) *Attorney, Agent, or Firm*—Dority & Manning, P.A.

(57) ABSTRACT

Textile materials, including paper webs, treated with a polyvinylamine polymer and a second agent that interacts with the polyvinylamine polymer is disclosed. The second agent added with the polyvinylamine polymer can be, for instance, a polymeric anionic reactive compound or a polymeric aldehyde-functional compound. When incorporated into a paper web, the combination of the polyvinylamine polymer and the second agent provide improved strength properties, such as wet strength properties. In an alternative embodiment, the polyvinylamine polymer and the second polymer can be applied to a textile material for increasing the affinity of the textile material for acid dyes.

17 Claims, 11 Drawing Sheets

POLYVINYLAMINE TREATMENTS TO IMPROVE DYEING OF CELLULOSIC MATERIALS

BACKGROUND OF THE INVENTION

In the art of tissue making and papermaking in general, many additives have been proposed for specific purposes, such as increasing wet strength, improving softness, or control of wetting properties. For instance, in the past, wet strength agents have been added to paper products in order to increase the strength or otherwise control the properties of the product when contacted with water and/or when used in a wet environment. For example, wet strength agents are added to paper towels so that the paper towel can be used to wipe and scrub surfaces after being wetted without the towel disintegrating. Wet strength agents are also added to facial tissues to prevent the tissues from tearing when contacting fluids. In some applications, wet strength agents are also added to bath tissues to provide strength to the tissues during use. When added to bath tissues, however, the wet strength agents should not prevent the bath tissue from disintegrating when dropped in a commode and flushed into a sewer line. Wet strength agents added to bath tissues are sometimes referred to as temporary wet strength agents since they only maintain wet strength in the tissue for a specific length of time.

Although great advancements have been made in providing wet strength properties to paper products, various needs still exist to increase wet strength properties in certain applications, or to otherwise better control the wet strength properties of paper products.

A need also exists for a composition that provides wet strength properties to a fibrous material, such as a paper web, while also providing sites to bond other additives to the material. For example, a need exists for a wet strength agent that can also be used to facilitate dyeing cellulosic materials, applying a softener to cellulosic materials, and applying other similar additives to cellulosic materials.

SUMMARY OF THE INVENTION

The present invention is generally directed to the use of polyvinylamines in fibrous and textile products, such as paper products, in order to control and improve various properties of the product. For instance, a polyvinylamine can be combined with a complexing agent to increase the wet strength of a paper product. The combination of a polyvinylamine and a complexing agent can also be used to render a web more hydrophobic, to facilitate the application of dyes to a cellulosic material, or to otherwise apply other additives to a cellulosic material.

In one embodiment, the present invention is directed to a paper product having improved wet strength properties. The paper product includes a fibrous web containing cellulosic fibers. The fibrous web further includes a combination of a polyvinylamine polymer and a polymeric anionic reactive compound. The polyvinylamine polymer and the polymeric anionic reactive compound can form a polyelectrolyte complex within the fibrous web. The paper product can be a paper towel, a facial tissue, a bath tissue, a wiper, or any other suitable product.

The polyvinylamine polymer can be incorporated into the web by being added to an aqueous suspension of fibers that is used to form the web. Alternatively, the polyvinylamine polymer can be applied to after the web has been formed. When applied to the surface, the polyvinylamine polymer can be printed or sprayed onto to the surface in a pattern in one application. The polyvinylamine polymer can be added prior to the polymeric anionic reactive compound, can be added after the polymeric anionic reactive compound, or can be applied simultaneously with the polymeric anionic reactive compound. The polyvinylamine polymer can be combined with the fibrous web as a homopolymer or a copolymer. In one embodiment, the polyvinylamine polymer is combined with the fibrous web as a partially hydrolyzed polyvinylformamide. For instance, the polyvinylformamide can be hydrolyzed from about 50% to about 90%, and particularly, from about 75% to about 95%.

In general, any suitable, polymeric anionic reactive compound can be used in the present invention. For instance, the polymeric anionic reactive compound can be an anionic polymer containing carboxylic acid groups, anhydride groups, or salts thereof. The polymeric anionic reactive compound can be, for instance, a copolymer of a maleic anhydride or a maleic acid or, alternatively, poly-1,2-diacid.

The polyvinylamine polymer and polymeric anionic reactive compound can each be added to the fibrous web in an amount of at least about 0.1% by weight, particularly at least 0.2% by weight, based upon the dry weight of the web. For instance, each polymer can be added to the fibrous web in an amount from about 0.1% to about 10% by weight, and particularly from about 0.1% to about 6% by weight. It should be understood, however, that greater quantities of the components can be added to the fibrous web depending upon the particular application. For instance, in some applications it may be desirable to add one of the polymers in a quantity of greater than 50% by weight.

As stated above, the polyvinylamine polymer in combination with the polymeric anionic reactive compound increases the wet strength of the web. In one embodiment, the polymers are added to the fibrous web in an amount such that the web has a 25 microliter Pipette Intake Time of greater than 30 seconds, and particularly greater than 60 seconds. The fibrous web can have a Water Drop Intake Time of greater than 30 seconds, and particularly greater than 60 seconds.

In addition to polymeric anionic reactive compounds, in an alternative embodiment, the present invention is directed to products and processes using the combination of a polyvinylamine polymer and a polymeric aldehyde functional compound, a glyoxylated polyacrylamide, or an anionic surfactant. Examples of polymeric aldehyde functional compounds include aldehyde celluloses and aldehyde functional polysaccharides. In this embodiment, a polymeric aldehyde functional compound, a glyoxylated polyacrylamide, or anionic surfactant can be used similar to a polymeric anionic reactive compound as discussed above.

In one embodiment, the present invention is directed to a method for improving the wet strength properties of a paper product. The method includes the steps of providing a fibrous web containing pulp fibers. The fibrous web is combined with a polyvinylamine and a complexing agent. The complexing agent can be a polymeric anionic reactive compound, a polymeric aldehyde functional compound, a glyoxylated polyacrylamide, an anionic surfactant, or mixtures thereof.

In one embodiment, the fibrous web is formed from an aqueous suspension of fibers. The polyvinylamine and the complexing agent are added to the aqueous suspension in order to be incorporated into the fibrous web. In another embodiment, the complexing agent is added to the aqueous suspension while the polyvinylamine is added after the web is formed. In still another embodiment, the polyvinylamine is added to the aqueous suspension, while the complexing agent is added after the web is formed. In still another embodiment, the polyvinylamine polymer and the complexing agent are both added after the web is formed.

In addition to increasing the wet strength of paper products, the process of the present invention can also be used to facilitate dyeing of a fibrous material. For instance, the present invention is further directed to a process for dyeing fibrous materials such as a textile with an acid dye. The process includes the steps of contacting a cellulosic fibrous material with a polyvinylamine and a complexing agent, such as a polymeric anionic reactive compound. Thereafter, the cellulosic fibrous material is contacted with an acid dye. It is believed that the complexing agent holds the polyvinylamine to the cellulosic material while the acid dye binds to the polyvinylamine.

The fibrous material can be a fiber, a yarn, or a fabric. The cellulosic material can be paper fibers, cotton fibers, or rayon fibers.

In addition to applying an acid dye to a fibrous material, a polyvinylamine can be used in accordance with the present invention to bind other additives to the material. For instance, in another embodiment, the process of the present invention is directed to applying polysiloxanes to fibrous materials that have been previously treated with a polyvinylamine in accordance with the present invention.

DETAILED DESCRIPTION OF THE INVENTION

Figure 1:
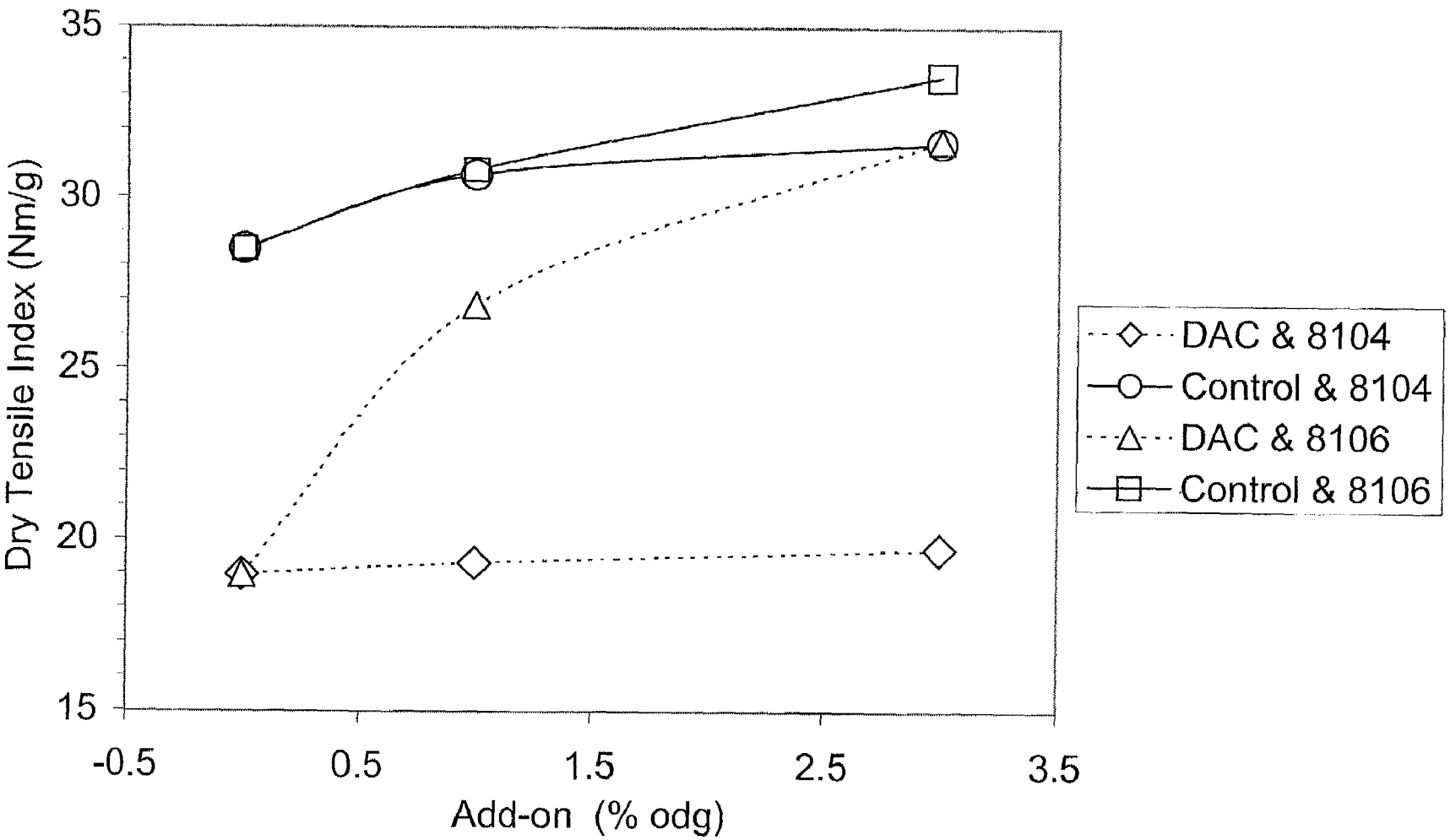
FIGS. 1 through 11 are graphical representations of some of the results obtained in the examples described below.

In general, the present invention is directed to adding polyvinylamine in combination with another agent, such as a complexing agent, to a fibrous material in order to improve the properties of the material. For instance, the polyvinylamine and the complexing agent can be added to a paper web in order to improve the strength properties of the web. The polyvinylamine in combination with the complexing agent can also be used to render a web hydrophobic. In fact, in one application, it has been discovered that the combination of the above components can produce a sizing effect on a web to the point that applied water will bead up on the web and not penetrate the web.

In another embodiment, it has also been discovered that the combination of a polyvinylamine and a complexing agent can be added to a textile material in order to increase the affinity of the textile material to acid dyes. The textile material can be made from, for instance, pulp fibers, cotton fibers, rayon fibers, or any other suitable cellulosic material.

Besides acid dyes, it has also been discovered that polyvinylamine in combination with a complexing agent can also receive and bond to other treating agents. For instance, the polyvinylamine and complexing agent can also increase the affinity of the web for softening agents, such as polysiloxanes.

Besides increasing the affinity of cellulosic materials to acid dyes, treating webs in accordance with the present invention can also increase the wet to dry strength ratio, provide improved sizing behavior such as increased contact angle or decreased wettability, and can improve the tactile properties of the web, such as lubricity.

Various different polymers and chemical compounds can be combined with a polyvinylamine in accordance with the present invention. Examples of suitable complexing agents include polymeric anionic reactive compounds, polymeric aldehyde functional compounds, anionic surfactants, mixtures thereof, and the like.

Cellulosic webs prepared in accordance with the present invention can be used for a wide variety of applications. For instance, products made according to the present invention include tissue products such as facial tissues or bath tissues, paper towels, wipers, and the like. Webs made according to the present invention can also be used in diapers, sanitary napkins, wet wipes, composite materials, molded paper products, paper cups, paper plates, and the like. Materials treated with an acid dye according to the present invention can be used in various textile applications, particularly in textile webs comprising a blend of cellulosic materials and wool, nylon, silk or other polyamide or protein-based fibers.

The present invention will now be discussed in greater detail. Each of the components used in the present invention will first be discussed followed by a discussion of the process used to form products in accordance with the present invention.

Polyvinylamine Polymers

In general, any suitable polyvinylamine may be used in the present invention. For instance, the polyvinylamine polymer can be a homopolymer or can be a copolymer.

Useful copolymers of polyvinylamine include those prepared by hydrolyzing polyvinylformamide to various degrees to yield copolymers of polyvinylformamide and polyvinylamine. Exemplary materials include the Catiofast® series sold commercially by BASF (Ludwigshafen, Germany). Such materials are also described in U.S. Pat. No. 4,880,497 to Phohl, et al. and U.S. Pat. No. 4,978,427 also to Phohl, et al., which are incorporated herein by reference.

These commercial products are believed to have a molecular weight range of about 300,000 to 1,000,000 Daltons, though polyvinylamine compounds having any practical molecular weight range can be used. For example, polyvinylamine polymers can have a molecular weight range of from about 5,000 to 5,000,000, more specifically from about 50,000 to 3,000,0000, and most specifically from about 80,000 to 500,000. The degree of hydrolysis, for polyvinylamines formed by hydrolysis of polyvinylformamide or a copolymer of polyvinylformamide or derivatives thereof, can be about any of the following or greater: 10%, 20%, 30%, 40%, 50%, 60%, 70%, 80%, 90%, and 95%, with exemplary ranges of from about 30% to 100%, or from about 50% to about 95%. In general, better results are obtained when a majority of the polyvinylformamide is hydrolyzed.

Polyvinylamine compounds that may be used in the present invention include copolymers of N-vinylformamide and other groups such as vinyl acetate or vinyl propionate, where at least a portion of the vinyl-formamide groups have been hydrolyzed. Exemplary compounds and methods are disclosed in U.S. Pat. Nos. 4,978,427; No. 4,880,497; 4,255,548; 4,421,602; and 2,721,140, all of which are herein incorporated by reference. Copolymers of polyvinylamine and polyvinyl alcohol are disclosed in U.S. Pat. No. 5,961,782, "Crosslinkable Creping Adhesive Formulations," issued Oct. 5, 1999 to Luu et al., herein incorporated by reference.

Polymeric Anionic Reactive Compounds

As stated above, according to the present invention, a polyvinylamine polymer is combined with a second component to arrive at the benefits and advantages of the present invention. In one embodiment, the polyvinylamine polymer is combined with a polymeric anionic reactive compound. When combined and added to a fibrous material such as a web made from cellulosic fibers, the combined polyvinylamine and the polymeric anionic reactive compound not only improve strength such as wet strength, but can also produce a sizing effect as well, offering increased control over the surface chemistry and wettability of the treated web.

In the past, polymeric anionic reactive compounds have been used in wet strength applications. The combination of a polymeric anionic reactive compound with a polyvinylamine, however, has produced unexpected benefits and advantages. For instance, web treated with a polymeric anionic reactive compound alone will have an increase in wet strength but will generally remain hydrophilic. Likewise, webs treated with a polyvinylamine will also show an increase in wet strength and remain hydrophilic. However, it has been discovered that addition of both ingredients, a polymeric anionic reactive compound and polyvinylamine polymer, can result not only in enhanced wet and dry strength, but can also, in one embodiment, provide a sizing effect wherein the treated web becomes hydrophobic. Thus, according to the present invention, it has been discovered that an increase in wet strength and a high degree of sizing can occur when using two compounds that are substantially hydrophilic when used alone.

This effect offers additional control over the properties of the treated web. Thus, wet and dry tensile properties can be controlled as well as the wettability or surface contact angle of the treated web by adjusting the amount of polyvinylamine in combination with the polymeric anionic reactive compound.

Polymeric anionic reactive compounds (PARC), as used herein, are polymers having repeating units containing two or more anionic functional groups that will covalently bond to hydroxyl groups of cellulosic fibers. Such compounds will cause inter-fiber crosslinking between individual cellulose fibers. In one embodiment, the functional groups are carboxylic acids, anhydride groups, or the salts thereof. In one embodiment, the repeating units include two carboxylic acid groups on adjacent atoms, particularly adjacent carbon atoms, wherein the carboxylic acid groups are capable of forming cyclic anhydrides and specifically 5-member ring anhydrides. This cyclic anhydride, in the presence of a cellulosic hydroxyl group at elevated temperature, forms ester bonds with the hydroxyl groups of the cellulose. Polymers, including copolymers, terpolymers, block copolymers, and homopolymers, of maleic acid represent one embodiment, including copolymers of acrylic acid and maleic acid. Polyacrylic acid can be useful for the present invention if a significant portion of the polymer (e.g., 15% of the monomeric units or greater, more specifically 40% or greater, more specifically still 70% or greater) comprises monomers that are joined head to head, rather than head to tail, to ensure that carboxylic acid groups are present on adjacent carbons. In one embodiment, the polymeric anionic reactive compound is a poly-1,2-diacid.

Exemplary polymeric anionic reactive compounds include the ethylene/maleic anhydride copolymers described in U.S. Pat. No. 4,210,489 to Markofsky, herein incorporated by reference. Vinyl/maleic anhydride copolymers and copolymers of epichlorohydrin and maleic anhydride or phthalic anhydride are other examples. Copolymers of maleic anhydride with olefins can also be considered, including poly(styrene/maleic anhydride), as disclosed in German Patent No. 2,936,239. Copolymers and terpolymers of maleic anhydride that can be used are disclosed in U.S. Pat. No. 4,242,408 to Evani et al., herein incorporated by reference. Examples of polymeric anionic reactive compounds include terpolymers of maleic acid, vinyl acetate, and ethyl acetate known as BELCLENE@ DP80 (Durable Press 80) and BELCLENE@ DP60 (Durable Press 60), from FMC Corporation (Philadelphia, Pa.).

Exemplary maleic anhydride polymers are disclosed in WO 99/67216, "Derivatized Polymers of Alpha Olefin Maleic Anhydride Alkyl Half Ester or Full Acid," published Dec. 29, 1999. Other polymers of value can include maleic anhydride-vinyl acetate polymers, polyvinyl methyl ether-maleic anhydride copolymers, such as the commercially available Gantrez-AN119 from International Specialty Products (Calvert City, Ky.), isopropenyl acetate-maleic anhydride copolymers, itaconic acid-vinyl acetate copolymers, methyl styrene-maleic anhydride copolymers, styrene-maleic anhydride copolymers, methylmethacrylate-maleic anhydride copolymers, and the like.

The polymeric anionic reactive compound can have any viscosity provided that the compound can be applied to the web. In one embodiment, the polymeric anionic reactive compound has a relatively low molecular weight and thus a low viscosity to permit effective spraying or printing onto a web. Useful polymeric anionic reactive compounds according to the present invention can have a molecular weight less than about 5,000, with an exemplary range of from about 500 to 5,000, more specifically less than about 3,000, more specifically still from about 600 to about 2,500, and most specifically from about 800 to 2,000 or from about 500 to 1,400. The polymeric anionic reactive compound BELCLENE@ DP80, for instance, is believed to have a molecular weight of from about 800 to about 1000. As used herein, molecular weight refers to number averaged molecular weight determined by gel permeation chromatography (GPC) or an equivalent method.

The polymeric anionic reactive compound can be a copolymer or terpolymer to improve flexibility of the molecule relative to the homopolymer alone. Improved flexibility of the molecule can be manifest by a reduced glass transition temperature as measured by differential scanning calorimetry. In aqueous solution, a low molecular weight compound such as BELCLENE® DP80 will generally have a low viscosity, simplifying the processing and application of the compound. In particular, low viscosity is useful for spray application, whether the spray is to be applied uniformly or nonuniformly (e.g., through a template or mask) to the product. A saturated (50% by weight) solution of BELCLENE© DP80, for example, has a room temperature viscosity of about 9 centipoise, while the viscosity of a solution diluted to 2%, with 1% SHP catalyst, is approximately 1 centipoise (only marginally greater than that of pure water).

In general, the polymeric anionic reactive compound to be applied to the paper web can have a viscosity at 25° C. of about 50 centipoise or less, specifically about 10 centipoise or less, more specifically about 5 centipoise or less, and most specifically from about 1 centipoise to about 2 centipoise. The solution at the application temperature can exhibit a viscosity less than 10 centipoise and more specifically less than 4 centipoise.

When the pure polymeric anionic reactive compound is at a concentration of either 50% by weight in water or as high as can be dissolved in water, whichever is greater, the liquid viscosity can be less than 100 centipoise, more specifically about 50 centipoise or less; more specifically still about 15 centipoise or less, and most specifically from about 4 to about 10 centipoise.

As used herein, "viscosity" is measured with a Sofrasser SA Viscometer (Villemandeur, France) connected to a type MIVI-6001 measurement panel. The viscometer employs a vibrating rod which responds to the viscosity of the surrounding fluid. To make the measurement, a 30 ml glass tube (Corex H No. 8445) supplied with the viscometer is filled with 10.7 ml of fluid and the tube is placed over the vibrating rod to immerse the rod in fluid. A steel guide around the rod receives the glass tube and allows the tube to be completely inserted into the device to allow the liquid depth over the vibrating rod to be reproducible. The tube is held in place for 30 seconds to allow the centipoise reading on the measurement panel to reach a stable value.

Another useful aspect of the polymeric anionic reactive compounds of the present invention is that relatively high pH values can be used when the catalyst is present, making the compound more suitable for neutral and alkaline papermaking processes and more suitable for a variety of processes, machines, and fiber types. In particular, polymeric anionic reactive compound solutions with added catalyst can have a pH above 3, more specifically above 3.5, more specifically still above 3.9, and most specifically of about 4 or greater, with an exemplary range of from 3.5 to 7 or from 4.0 to 6.5. These same pH values can be maintained in combination with the polyvinylamine polymer solution.

The polymeric anionic reactive compounds of the present invention can yield wet:dry tensile ratios much higher than traditional wet strength agents, with values reaching ranges as high as from 30% to 85%, for example. The PARC need not be neutralized prior to treatment of the fibers. In particular, the PARC need not be neutralized with a fixed base. As used herein, a fixed base is a monovalent base that is substantially nonvolatile under the conditions of treatment, such as sodium hydroxide, potassium hydroxide, or sodium carbonate, and t-butylammonium hydroxide. However, it can be desirable to use co-catalysts, including volatile basic compounds such as imidazole or triethyl amine, with sodium hypophosphite or other catalysts.

Without wishing to be bound by the following theory, it is believed that a polyvinylamine polymer containing amino groups can react in solution with the polymeric anionic reactive compound, particularly with the carboxyl groups to yield a polyelectrolyte complex (sometimes termed a coacervate) that upon heating, reacts to form amide bonds that crosslink the two molecules, leaving a hydrophobic backbone. Other carboxyl groups on the polymeric anionic reactive compound can form ester cross links with hydroxyl groups on the cellulose, while amino groups on the polyvinylamine polymer can form hydrogen bonds with hydroxyl groups on the cellulose or covalent bonds with functional groups on the cellulose, such as aldehyde groups that may have been added by enzymatic or chemical treatment, or with carboxyl groups on the cellulose that may have been provided by chemical treatment such as certain forms of bleaching or ozonation. The result is a treated web with added cross linking for wet and dry strength properties, with a high degree of hydrophobicity due to depleted hydrophilic groups on the reacted polymers.

In one embodiment, the polymeric anionic reactive compound can be used in conjunction with a catalyst. Suitable catalysts for use with PARC include any catalyst that increases the rate of bond formation between the PARC and cellulose fibers. Useful catalysts include alkali metal salts of phosphorous containing acids such as alkali metal hypophosphites, alkali metal phosphites, alkali metal polyphosphonates, alkali metal phosphates, and alkali metal sulfonates. Particularly desired catalysts include alkali metal polyphosphonates such as sodium hexametaphosphate, and alkali metal hypophosphites such as sodium hypophosphite. Several organic compounds are known to function effectively as catalysts as well, including imidazole (IMDZ) and triethyl amine (TEA). Inorganic compounds such as aluminum chloride and organic compounds such as hydroxyethane diphosphoric acid can also promote crosslinking.

Other specific examples of effective catalysts are disodium acid pyrophosphate, tetrasodium pyrophosphate, pentasodium tripolyphosphate, sodium trimetaphosphate, sodium tetrametaphosphate, lithium dihydrogen phosphate, sodium dihydrogen phosphate and potassium dihydrogen phosphate.

When a catalyst is used to promote bond formation, the catalyst is typically present in an amount in the range from about 5 to about 100 weight percent of the PARC. The catalyst is present in an amount of about 25 to 75% by weight of the polycarboxylic acid, most desirably about 50% by weight of the PARC.

As will be described in more detail below, the polymeric anionic reactive compound can be added with a polyvinylamine polymer using various methods and techniques depending upon the particular application. For instance, one or both of the components can be added during formation of the cellulosic material or can be applied to a surface of the material. The two components can be added simultaneously or can be added one after the other.

For instance, the PARC can be applied independently of the polyvinylamine polymers on the web, meaning that it can be applied in a distinct step or steps and/or applied to a different portion of the web or the fibers than the polyvinylamine polymers. The PARC can be applied in an aqueous solution to an existing papermaking web. The solution can be applied either as an online step in a continuous papermaking process along a section of a papermaking machine or as an offline or converting step following formation, drying, and reeling of a paper web. The PARC solution is can be added at about 10 to 200% add-on, more specifically from about 20% to 100% add-on, most specifically from about 30% to 75% add-on, where add-on is the percent by weight of PARC solution to the dry weight of the web. In other words, 100% add-on is a 1:1 weight ratio of PARC solution to dry web. The final percent by weight PARC to the web can be from about 0.1 to 6%, more specifically from about 0.2% to 1.5%. The concentration of the PARC solution can be adjusted to ensure that the desired amount of PARC is added to the web.

In one embodiment, the PARC is applied heterogeneously to the web, with heterogeneity due to the z-direction distribution of PARC or due to the distribution of the PARC in the plane of the web. In the former case, the PARC may be selectively applied to one or both surfaces of the web, with a relatively lower concentration of the PARC in the middle of the web or on an untreated surface. In the case of in-plane heterogeneity, the PARC may be applied to the web in a pattern such that some portions of the treated surface or surfaces of the web have little or no PARC, while other portions have an effective quantity capable of significantly increasing wet performance in those portions. Applying PARC in a stratum of web can allow a web to have overall wet strength while permitting the untreated layer to provide high softness, which can be adversely effected by the crosslinking of fibers caused by PARC treatment. Thus, paper towels, toilet paper, facial tissue, and other tissue products can advantageously exploit the combination of properties obtained by restricting PARC treatment to a single stratum of a web, particularly in a multi-ply product wherein the treated stratum can be placed toward the interply region, away from the outer surfaces that may contact the skin.

In preparing a web comprising both a polyvinylamine compound and PARC, any ratio of polyvinylamine compound mass to PARC mass can be used. For example, the ratio of polyvinylamine compound mass to PARC mass can be from 0.01 to 100, more specifically from 0.1 to 10, more specifically still from 2 to 5, and most specifically from 0.5 to 1.5.

Polymeric Aldehyde-Functional Compounds

Besides polymeric anionic reactive compounds, another class of compounds that can be used with a polyvinylamine in accordance with the present invention are polymeric aldehyde-functional compounds.

In general, polyvinylamines can be combined with polymeric aldehyde-functional compounds and papermaking fibers or other cellulosic fibers to create improved physical and chemical properties in the resulting web. The polymeric aldehyde-functional compounds can comprise gloxylated polyacrylamides, aldehyde-rich cellulose, aldehyde-functional polysaccharides, and aldehyde functional cationic, anionic or non-ionic starches. Exemplary materials include those disclosed by lovine, et.al., in U.S. Pat. No. 4,129,722, herein incorporated by reference. An example of a commercially available soluble cationic aldehyde functional starch is Cobond® 1000 marketed by National Starch. Additional exemplary materials include aldehyde polymers such as those disclosed by Bjorkquist in U.S. Pat. No. 5,085,736; by Shannon et al. in U.S. Pat. No. 6,274,667; and by Schroeder, et al. in U.S. Pat. No. 6,224,714; all of which are herein incorporated by reference, as well as the those of WO 00/43428 and the aldehyde functional cellulose described by Jaschinski in WO 00/50462 A1 and WO 01/34903 A1. The polymeric aldehyde-functional compounds can have a molecular weight of about 10,000 or greater, more specifically about 100,000 or greater, and more specifically about 500,000 or greater. Alternatively, the polymeric aldehyde-functional compounds can have a molecular weight below about 200,000, such as below about 60,000.

Further examples of aldehyde-functional polymers of use in the present invention include dialdehyde guar, aldehyde-functional wet strength additives further comprising carboxylic groups as disclosed in WO 01/83887, published Nov. 8, 2001 by Thornton, et al., dialdehyde inulin; and the dialdehyde-modified anionic and amphoteric polyacrylamides of WO 00/11046, published Mar. 2, 2000, the U.S. equivalent of which is application Ser. No. 99/18706, filed Aug. 19, 1998 by Geer and Staib of Hercules, Inc., herein incorporated by reference. Aldehyde-containing surfactants as disclosed in U.S. Pat. No. 6,306,249 issued Oct. 23, 2001 to Galante, et al., can also be used.

When used in the present invention, the aldehyde-functional compound can have at least 5 milliequivalents (meq) of aldehyde per 100 grams of polymer, more specifically at least 10 meq, more specifically still about 20 meq or greater, and most specifically about 25 meq per 100 grams of polymer or greater.

In one embodiment, polyvinylamine, when combined with aldehyde-rich cellulose such as dialdehyde cellulose or a sulfonated dialdehyde cellulose, can significantly increase wet and dry strength beyond what is possible with curing of dialdehyde cellulose alone, and that these gains can be achieved without the need for temperatures above the normal drying temperatures of paper webs (e.g., about 100° C.). The aldehyde-rich cellulose can include cellulose oxidized with periodate solutions, as disclosed in U.S. Pat. No. 5,703,225, issued Dec. 30, 1997 to Shet et al., herein incorporated by reference, cellulose treated with enzymes, such as the cellulase-treated cellulose of WO 97/27363, "Production of Sanitary Paper," published Jul. 31, 1997, and the aldehyde-modified cellulose products of National Starch, including that disclosed in EP 1,077,286-A1, published Feb. 21, 2001.

In another embodiment, the polymeric aldehyde-functional compound can be a glyoxylated polyacrylamide, such as a cationic glyoxylated polyacrylamide. Such compounds include PAREZ 631 NC wet strength resin available from Cytec Industries of West Patterson, N.J., chloroxylated polyacrylamides described in U.S. Pat. No. 3,556,932 to Coscia, et al. and U.S. Pat. No. 3,556,933 to Williams, et al. which are incorporated herein by reference, and HERCOBOND 1366, manufactured by Hercules, Inc. of Wilmington, Del. Another example of a glyoxylated polyacrylamide is PAREZ 745, which is a glyoxylated poly(acrylamide-co-diallyl dymethyl ammonium chloride). At times it may be advantageous to utilize a mixture of high and low molecular weight glyoxylated polyacrylamides to obtain a desire effect.

The above described cationic glyoxylated polyacrylamides have been used in the past as wet strength agents. In particular, the above compounds are known as temporary wet strength additives. As used herein, a temporary wet strength agent, as opposed to a permanent wet strength agent, is defined as those resins which, when incorporated into paper or tissue products, will provide a product which retains less than 50% of its original wet strength after exposure to water for a period of at least 5 minutes. Permanent wet strength agents, on the other hand, provide a product that will retain more than 50% of its original wet strength after exposure to water for a period of at least 5 minutes. In accordance with the present invention, it has been discovered that when a glyoxylated polyacrylamide, which is known to be a temporary wet strength agent, is combined with a polyvinylamine polymer in a paper web, the combination of the two components can result in permanent wet strength characteristics.

In this manner, the wet strength characteristics of a paper product can be carefully controlled by adjusting the relative amounts of the glyoxylated polyacrylamide and the polyvinylamine polymer.

Other Compositions that Can Be Used with A Polyvinlamine Polymer

In accordance with the present invention, various other components can also be combined with the polyvinylamine polymer. For instance, in one application, other wet strength agents not identified above can be used.

As used herein, "wet strength agents" are materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it can be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph and other body exudates.

Any material that when added to a paper web or sheet results in providing the sheet with a mean wet geometric tensile strength: dry geometric tensile strength ratio in excess of 0.1 will, for purposes of this invention, be termed a wet strength agent. As described above, typically these materials are termed either as permanent wet strength agents or as temporary wet strength agents.

In accordance with the present invention, various permanent wet strength agents and temporary wet strength agents can be used in combination with a polyvinylamine polymer. In some applications, it has been found that temporary wet strength agents combined with a polyvinylamine polymer can result in a composition having permanent wet strength characteristics. In general, the wet strength agents that can be used in accordance with the present invention can be cationic, nonionic or anionic. In one embodiment, the additives are not strongly cationic to decrease repulsive forces in the presence of cationic polyvinylamine.

Permanent wet strength agents comprising cationic oligomeric or polymeric resins can be used in the present invention, but do not generally yield the synergy observed with less cationic additives. Polyamide-polyamine-epichlorohydrin type resins such as KYMENE 557H sold by Hercules, Inc. (Wilmington, Del.) are the most widely used permanent wet-strength agents, but have come under increasing environmental scrutiny due to the reactive halogen group in these molecules. Such materials have been described in patents issued to Keim (U.S. Pat. Nos. 3,700,623 and 3,772,076), Petrovich (U.S. Pat. Nos. 3,885,158; 3,899,388; 4,129,528 and 4,147,586) and van Eenam (U.S. Pat. No. 4,222,921). Other cationic resins include polyethylenimine resins and aminoplast resins obtained by reaction of formaldehyde with melamine or urea.

Besides wet strength agents, another class of compounds that may be used with a polyvinylamine polymer in accordance with the present invention are various anionic or noncationic (e.g., zwitterionic) surfactants. Such surfactants can include, for instance, linear and branched-chain sodium alkylbenzenesulfonates, linear and branched-chain alkyl sulfates, and linear and branched chain alkyl ethoxy sulfates. Noncationic and zwitterionic surfactants are further described in U.S. Pat. No. 4,959,125, "Soft Tissue Paper Containing Noncationic Surfactant," issued Sep. 25, 1990 to Spendel, herein incorporated by reference. The surfactant can be applied by any conventional means, such as spraying, printing, brush coating, and the like. Two or more surfactants may be combined in any manner, if desired.

Process for Applying Polyvinylamine Polymers in Conjunction with other Agents to Paper Webs In one embodiment of the present invention, a polyvinylamine polymer is added to a paper web in conjunction with a complexing agent, such as a polymeric anionic reactive compound or a polymeric aldehyde functional compound in order to provide various benefits to the web, including improved wet strength. The polyvinylamine polymer and the complexing agent, in one embodiment, can be applied as aqueous solutions to a cellulosic web, fibrous slurry or individual fibers. In addition to being applied as an aqueous solution, the complexing agent can also be applied in the form of a suspension, a slurry or as a dry reagent depending upon the particular application. When used as a dry reagent, sufficient water should be available to permit interaction of the complexing agent with the molecules of the polyvinylamine polymer.

The polyvinylamine polymer and the complexing agent may be combined first and then applied to a web or fibers, or the two components may be applied sequentially in either order. After the two components have been applied to the web, the web or fibers are dried and heatedly sufficiently to achieve the desired interaction between the two compounds.

By way of example only, application of either the polyvinylamine polymer or the complexing agent can be applied by any of the following methods or combinations thereof:

- Direct addition to a fibrous slurry, such as by injection of the compound into a slurry prior to entry in the headbox. Slurry consistency can be from 0.2% to about 50%, specifically from about 0.2% to 10%, more specifically from about 0.3% to about 5%, and most specifically from about 1% to 4%.
- A spray applied to a fibrous web. For example, spray nozzles may be mounted over a moving paper web to apply a desired dose of a solution to a web that can be moist or substantially dry.
- Application of the chemical by spray or other means to a moving belt or fabric which in turn contacts the tissue web to apply the chemical to the web, such as is disclosed in WO 01/49937 by S. Eichhorn "A Method of Applying Treatment Chemicals to a Fiber-Based Planar Product Via a Revolving Belt and Planar Products Made using Said Method," published Jun. 12, 2001.
- Printing onto a web, such as by offset printing, gravure printing, flexographic printing, ink jet printing, digital printing of any kind, and the like.
- Coating onto one or both surfaces of a web, such as blade coating, air knife coating, short dwell coating, cast coating, and the like.
- Extrusion from a die head of polyvinylamine polymer in the form of a solution, a dispersion or emulsion, or a viscous mixture comprising a polyvinylamine polymer and a wax, softener, debonder, oil, polysiloxane compound or other silicone agent, an emollient, a lotion, an ink, or other additive, as disclosed, for example, in WO 2001/12414, published Feb. 22, 2001, the US equivalent of which is herein incorporated by reference.
- Application to individualized fibers. For example, comminuted or flash dried fibers may be entrained in an air stream combined with an aerosol or spray of the compound to treat individual fibers prior to incorporation into a web or other fibrous product.
- Impregnation of a wet or dry web with a solution or slurry, wherein the compound penetrates a significant distance into the thickness of the web, such as more than 20% of the thickness of the web, more specifically at least about 30% and most specifically at least about 70% of the thickness of the web, including completely penetrating the web throughout the full extent of its thickness. One useful method for impregnation of a moist web is the Hydra-Sizer® system, produced by Black Clawson Corp., Watertown, N.Y., as described in "New Technology to Apply Starch and Other Additives," Pulp and Paper Canada, 100(2): T42–T44 (February 1999). This system includes a die, an adjustable support structure, a catch pan, and an additive supply system. A thin curtain of descending liquid or slurry is created which contacts the moving web beneath it. Wide ranges of applied doses of the coating material are said to be achievable with good runnability. The system can also be applied to curtain coat a relatively dry web, such as a web just before or after creping.
- Foam application of the additive to a fibrous web (e.g., foam finishing), either for topical application or for impregnation of the additive into the web under the influence of a pressure differential (e.g., vacuum-assisted impregnation of the foam). Principles of foam application of additives such as binder agents are described in the following publications: F. Clifford, "Foam Finishing Technology: The Controlled Application of Chemicals to a Moving Substrate," *Textile Chemist and Colorist,* Vol. 10, No. 12, 1978, pages 37–40; C. W. Aurich, "Uniqueness in Foam Application," *Proc.* 1992 *Tappi Nonwovens Conference,* Tappi Press, Atlanta, Ga., 1992, pp. 15–19; W. Hartmann, "Application Techniques for Foam Dyeing & Finishing", *Canadian Textile Journal,* April 1980, p. 55; U.S. Pat. No. 4,297,860, "Device for Applying Foam to Textiles," issued Nov. 3, 1981 to Pacifici et al., herein incorporated by reference; and U.S. Pat. No. 4,773,110, "Foam Finishing Apparatus and Method," issued Sep. 27, 1988 to G. J. Hopkins, herein incorporated by reference.

Padding of a solution into an existing fibrous web.

Roller fluid feeding of a solution for application to the web.

When applied to the surface of a paper web, topical application of the polyvinylamine or the complexing agent can occur on an embryonic web prior to Yankee drying or through drying, and optionally after final vacuum dewatering has been applied.

The application level can be from about 0.1% to about 10% by weight relative to the dry mass of the web for of any of the polyvinylamine polymer and the complexing agent. More specifically, the application level can be from about 0.1% to about 4%, or from about 0.2% to about 2%. Higher and lower application levels are also within the scope of the present invention. In some embodiments, for example, application levels of from 5% to 50% or higher can be considered.

The polyvinylamine polymer when combined with the web or with cellulosic fibers can have any pH, though in many embodiments it is desired that the polyvinylamine solution in contact with the web or with fibers have a pH below any of 10, 9, 8 and 7, such as from 2 to about 8, specifically from about 2 to about 7, more specifically from about 3 to about 6, and most specifically from about 3 to 5.5. Alternatively, the pH range may be from about 5 to about 9, specifically from about 5.5 to about 8.5, and most specifically from about 6 to about 8. These pH values can apply to the polyvinylamine polymer prior to contacting the web or fibers, or to a mixture of polyvinylamine polymer and a second compound in contact with the web or the fibers prior to drying.

Before the polyvinylamine polymer and/or complexing agent is applied to an existing web, such as a moist embryonic web, the solids level of the web may be about 10% or higher (i.e., the web comprises about 10 grams of dry solids and 90 grams of water, such as about any of the following solids levels or higher: 12%, 15%, 18%, 20%, 25%, 30%, 35%, 40%, 45%, 50%, 60%, 75%, 80%, 90%, 95%, 98%, and 99%, with exemplary ranges of from about 30% to about 100% and more specifically from about 65% to about 90%.

Ignoring the presence of chemical compounds other than polyvinylamine compounds and focusing on the distribution of polyvinylamine polymers in the web, one skilled in the art will recognize that the polyvinylamine polymers (including derivatives thereof) can be distributed in a wide variety of ways. For example, polyvinylamine polymers may be uniformly distributed, or present in a pattern in the web, or selectively present on one surface or in one layer of a multilayered web. In multi-layered webs, the entire thickness of the paper web may be subjected to application of polyvinylamine polymers and other chemical treatments described herein, or each individual layer may be independently treated or untreated with the polyvinylamine polymers and other chemical treatments of the present invention. In one embodiment, the polyvinylamine polymers of the present invention are predominantly applied to one layer in a multilayer web. Alternatively, at least one layer is treated with significantly less polyvinylamine than other layers. For example, an inner layer can serve as a treated layer with increased wet strength or other properties.

The polyvinylamine polymers may also be selectively associated with one of a plurality of fiber types, and may be adsorbed or chemisorbed onto the surface of one or more fiber types. For example, bleached kraft fibers can have a higher affinity for polyvinylamine polymers than synthetic fibers that may be present.

Special chemical distributions may occur in webs that are pattern densified, such as the webs disclosed in any of the following U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; and U.S. Pat. No. 5,628,876, issued May 13, 1997 to Ayers et al., the disclosures of which are incorporated herein by reference to the extent that they are non-contradictory herewith.

In such webs, the polyvinylamine or other chemicals can be selectively concentrated in the densified regions of the web (e.g., a densified network corresponding to regions of the web compressed by an imprinting fabric pressing the web against a Yankee dryer, wherein the densified network can provide good tensile strength to the three-dimensional web). This is particularly so when the densified regions have been imprinted against a hot dryer surface while the web is still wet enough to permit migration of liquid between the fibers to occur by means of capillary forces when a portion of the web is dried. In this case, migration of the aqueous solution of polyvinylamine can move the polymer toward the densified regions experiencing the most rapid drying or highest levels of heat transfer.

The principle of chemical migration at a microscopic level during drying is well attested in the literature. See, for example, A. C. Dreshfield, "The Drying of Paper," *Tappi Journal,* Vol. 39, No. 7, 1956, pages 449–455; A. A. Robertson, "The Physical Properties of Wet Webs. Part I," *Tappi Journal,* Vol. 42, No. 12, 1959, pages 969–978; U.S. Pat. No. 5,336,373, "Method for Making a Strong, Bulky, Absorbent Paper Sheet Using Restrained Can Drying," issued Aug. 9, 1994 to Scattolino et al., herein incorporated by reference, and U.S. Pat. No. 6,210,528, "Process of Making Web-Creped Imprinted Paper," issued Apr. 3, 2001 to Wolkowicz, herein incorporated by reference. Without wishing to be bound by theory, it is believed that significant chemical migration may occur during drying when the initial solids content (dryness level) of the web is below about 60% (specifically, less than any of 65%, 63%, 60%, 55%, 50%, 45%, 40%, 35%, 30%, and 27%, such as from about 30% to 60%, or from about 40% to about 60%). The degree of chemical migration will depend on the surface chemistry of the fibers and the chemicals involved, the details of drying, the structure of the web, and so forth. On the other hand, if the web with a solid contents below about 60% is through-dried to a high dryness level, such as at least any of about 60% solids, about 70% solids, and about 80% solids (e.g., from 65% solids to 99% solids, or from 70% solids to 87% solids), then regions of the web disposed above the deflection conduits (i.e., the bulky "domes" of the pattern-densified web) may have a higher concentration of polyvinylamine or other water-soluble chemicals than the densified regions, for drying will tend to occur first in the regions of the web through which air can readily pass, and capillary wicking can bring fluid from adjacent portions of the web to the regions where drying is occurring most rapidly. In short, depending on how drying is carried out, water-soluble reagents may be present at a relatively higher concentration (compared to other portions of the web) in the densified regions or the less densified regions ("domes").

The reagents may also be present substantially uniformly in the web, or at least without a selective concentration in either the densified or undensified regions.

Preparation of Paper Webs for Use in the Present Invention

The fibrous web to be treated in accordance with the present invention can be made by any method known in the art. Airlaid webs can be used, such as those made with DanWeb or Kroyer equipment. The web can be wetlaid, such as webs formed with known papermaking techniques wherein a dilute aqueous fiber slurry is disposed on a moving wire to filter out the fibers and form an embryonic web which is subsequently dewatered by combinations of units including suction boxes, wet presses, dryer units, and the like. Examples of known dewatering and other operations are given in U.S. Pat. No. 5,656,132 to Farrington et al. Capillary dewatering can also be applied to remove water from the web, as disclosed in U.S. Pat. Nos. 5,598,643 issued Feb. 4, 1997 and 4,556,450 issued Dec. 3, 1985, both to S. C. Chuang et al.

Drying operations can include drum drying, through drying, steam drying such as superheated steam drying, displacement dewatering, Yankee drying, infrared drying, microwave drying, radio frequency drying in general, and impulse drying, as disclosed in U.S. Pat. No. 5,353,521, issued Oct. 11, 1994 to Orloff; and U.S. Pat. No. 5,598,642, issued Feb. 4, 1997 to Orloff et al. Other drying technologies can be used, such as those described by R. James in "Squeezing More out of Pressing and Drying," *Pulp and Paper International,* Vol. 41, No. 12 (December 1999), pp. 13–17. Displacement dewatering is described by J. D. Lindsay, "Displacement Dewatering To Maintain Bulk," *Paperi Ja Puu,* vol. 74, No. 3, 1992, pp. 232–242. In drum drying, the dryer drum can also be a Hot Roll Press (HRP), as described by M. Foulger and J. Parisian in "New Developments in Hot Pressing," *Pulp and Paper Canada,* Vol. 101, No. 2, February 2000, pp. 47–49. Other methods employing differential gas pressure include the use of air presses as disclosed U.S. Pat. No. 6,096,169, "Method for Making Low-Density Tissue with Reduced Energy Input," issued Aug. 1, 2000 to Hemans et al.; and U.S. Pat. No. 6,143,135, "Air Press For Dewatering A Wet Web," issued Nov. 7, 2000 to Hada et al. Also relevant are the paper machines disclosed in U.S. Pat. No. 5,230,776 issued Jul. 27, 1993 to I. A. Andersson et al.

A moist fibrous web can also be formed by foam forming processes, wherein the fibers are entrained or suspended in a foam prior to dewatering, or wherein foam is applied to an embryonic web prior to dewatering or drying. Exemplary methods include those of U.S. Pat. No. 5,178,729, issued Jan. 12, 1993 to Janda; and U.S. Pat. No. 6,103,060, issued Aug. 15, 2000 to Munerelle et al., both of which are herein incorporated by reference.

For tissue webs, both creped and uncreped methods of manufacture can be used. Uncreped tissue production is disclosed in U.S. Pat. No. 5,772,845 to Farrington, Jr. et al., herein incorporated by reference. Creped tissue production is disclosed in U.S. Pat. No. 5,637,194 to Ampulski et al., U.S. Pat. No. 4,529,480 to Trokhan, U.S. Pat. No. 6,103,063, issued Aug. 15, 2000 to Oriaran et al., and U.S. Pat. No. 4,440,597 to Wells et al, all of which are herein incorporated by reference.

For either creped or uncreped methods, embryonic tissue webs may be imprinted against a deflection member prior to complete drying. Deflection members have deflection conduits between raised elements, and the web is deflected into the deflection member by an air pressure differential to create bulky domes, while the portions of the web residing on the surface of the raised elements can be pressed against the dryer surface to create a network of pattern densified areas offering strength. Deflection members and fabrics of use in imprinting a tissue, as well as related methods of tissue manufacture, are disclosed in the following: in U.S. Pat. No. 5,855,739, issued to Ampulski et al. Jan. 5, 1999; U.S. Pat. No. 5,897,745, issued to Ampulski et al. Apr. 27, 1999; U.S. Pat. No. 4,529,480, issued Jul. 16, 1985 to Trokhan; U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep.10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 6,010,598, issued Jan. 4, 2000 to Boutilier et al.; and U.S. Pat. No. 5,628,876, issued May 13, 1997 to Ayers et al., all of which are herein incorporated by reference.

The fibrous web is generally a random plurality of papermaking fibers that can, optionally, be joined together with a binder. Any papermaking fibers, as previously defined, or mixtures thereof may be used, such as bleached fibers from a kraft or sulfite chemical pulping process. Recycled fibers can also be used, as can cotton linters or papermaking fibers comprising cotton. Both high-yield and low-yield fibers can be used. In one embodiment, the fibers may be predominantly hardwood, such as at least 50% hardwood or about 60% hardwood or greater or about 80% hardwood or greater or substantially 100% hardwood. In another embodiment, the web is predominantly softwood, such as at least about 50% softwood or at least about 80% softwood, or about 100% softwood.

For many tissue applications, high brightness may be desired. Thus the papermaking fibers or the resulting paper of the present invention can have an ISO brightness of about 60 percent or greater, more specifically about 80 percent or greater, more specifically about 85 percent or greater, more specifically from about 75 percent to about 90 percent, more specifically from about 80 percent to about 90 percent, and more specifically still from about 83 percent to about 88 percent.

The fibrous web of the present invention may be formed from a single layer or multiple layers. Both strength and softness are often achieved through layered tissues, such as stratified webs wherein at least one layer comprises softwood fibers while another layer comprises hardwood or other fiber types. Layered structures produced by any means known in the art are within the scope of the present invention, including those disclosed by Edwards et al. in U.S. Pat. No. 5,494,554. In the case of multiple layers, the layers are generally positioned in a juxtaposed or surface-to-surface relationship and all or a portion of the layers may be bound to adjacent layers. The paper web may also be formed from a plurality of separate paper webs wherein the separate paper webs may be formed from single or multiple layers.

When producing stratified webs, the webs can be made by employing a single headbox with two or more strata, or by employing two or more headboxes depositing different furnishes in series on a single forming fabric, or by employing two or more headboxes each depositing a furnish on a separate forming fabric to form an embryonic web followed by joining ("couching") the embryonic webs together to form a multi-layered web. The distinct furnishes may be differentiated by at least one of consistency, fiber species (e.g., eucalyptus vs. softwood, or southern pine versus northern pine), fiber length, bleaching method (e.g., peroxide bleaching vs. chlorine dioxide bleaching), pulping method (e.g., kraft versus sulfite pulping, or BCTMP vs. kraft), degree of refining, pH, zeta potential, color, Canadian Standard Freeness (CSF), fines content, size distribution, synthetic fiber content (e.g., one layer having 10% polyolefin fibers or bicomponent fibers of denier less than 6), and the presence of additives such as fillers (e.g., $CaCO_3$, talc, zeolites, mica, kaolin, plastic particles such as ground polyethylene, and the like) wet strength agents, starch, dry strength additives, antimicrobial additives, odor control agents, chelating agents, chemical debonders, quaternary ammonia compounds, viscosity modifiers (e.g., CMC, polyethylene oxide, guar gum, xanthan gum, mucilage, okra extract, and the like), silicone compounds, fluorinated polymers, optical brighteners, and the like. For example, in U.S. Pat. No. 5,981,044, issued Nov. 9, 1999, Phan et al. disclose the use of chemical softeners that are selectively distributed in the outer layers of the tissue.

Stratified headboxes for producing multilayered webs are described in U.S. Pat. No. 4,445,974, issued May 1, 1984, to Stenberg; U.S. Pat. No. 3,923,593, issued Dec. 2, 1975 to Verseput; U.S. Pat. No. 3,225,074 issued to Salomon et al., and U.S. Pat. No. 4,070,238, issued Jan. 24, 1978 to Wahren. By way of example, useful headboxes can include a four-layer Beloit (Beloit, Wis.) Concept III headbox or a Voith Sulzer (Ravensburg, Germany) ModuleJet® headbox in multilayer mode. Principles for stratifying the web are taught by Kearney and Wells in U.S. Pat. No. 4,225,382, issued Sep. 30, 1980, which discloses the use of two or more layers to form ply-separable tissue. In one embodiment, a first and second layer are provided from slurry streams differing in consistency. In another embodiment, two well-bonded layers are separated by an interior barrier layer such as a film of hydrophobic fibers to enhance ply separability. Dunning in U.S. Pat. No. 4,166,001, issued Aug. 28, 1979 also discloses a layered tissue with strength agents in the outer layers of the web with debonders in the inner layer. Taking a different approach aimed at improving tactile properties, Carstens in U.S. Pat. No. 4,300,981, issued Nov. 17, 1981, discloses a layered web with relatively short fibers on one or more outer surfaces of the tissue web. A layered web with shorter fibers on an outer surface and longer fibers for strength being in another layer is also disclosed by Morgan and Rich in U.S. Pat. No. 3,994,771 issued Nov. 30, 1976. Similar teaching are found in U.S. Pat. No. 4,112,167 issued Sep. 5, 1978 to Dake et al. and in U.S. Pat. No. 5,932,068, issued Aug. 3, 1999 to Farrington, Jr. et al. issued to Farrington et al., herein incorporated by reference. Other principles for layered web production are also disclosed in U.S. Pat. No. 3,598,696 issued to Beck and U.S. Pat. No. 3,471,367, issued to Chupka.

In one embodiment, the papermaking web itself comprises multiple layers having different fibers or chemical additives. Tissue in layered form can be produced with a stratified headbox or by combining two or more moist webs from separate headboxes. In one embodiment, an initial pulp suspension is fractionated into two or more fractions differing in fiber properties, such as mean fiber length, percentage of fines, percentage of vessel elements, and the like. Fractionation can be achieved by any means known in the art, including screens, filters, centrifuges, hydrocyclones, application of ultrasonic fields, electrophoresis, passage of a suspension through spiral tubing or rotating disks, and the like. Fractionation of a pulp stream by acoustic or ultrasonic forces is described in P. H. Brodeur, "Acoustic Separation in a Laminar Flow", Proceedings of IEEE Ultrasonics Symposium Cannes, France, pp 1359–1362 (November 1994), and in U.S. Pat. No. 5,803,270, "Methods and Apparatus for Acoustic Fiber Fractionation," issued Sep. 8, 1998 to Brodeur, herein incorporated by reference. The fractionated pulp streams can be treated separately by known processes, such as by combination with additives or other fibers, or adjustment of the consistency to a level suitable for paper formation, and then the streams comprising the fractionated fibers can be directed to separate portions of a stratified headbox to produce a layered tissue product. The layered sheet may have two, three, four, or more layers. A two-layered sheet may have splits based on layer basis weights such that the lighter layer has a mass of about 5% or more of the basis weight of the overall web, or about 10% or more, 20% or more, 30% or more, 40% or more, or about 50%. Exemplary weight percent splits for a three-layer web include 20%/20%/60%; 20%/60%/20%; 37.5%/25%/37.5%.; 10%/50%/40%; 40%/20%/40%; and approximately equal splits for each layer. In one embodiment, the ratio of the basis weight of an outer layer to an inner layer can be from about 0.1 to about 5; more specifically from about 0.2 to 3, and more specifically still from about 0.5 to about 1.5. A layered paper web according to the present invention can serve as a basesheet for a double print creping operation, as described in U.S. Pat. No. 3,879,257, issued Apr. 22, 1975 to Gentile et al., previously incorporated by reference.

In another embodiment, tissue webs of the present invention comprise multilayered structures with one or more layers having over 20% high yield fibers such as CTMP or BCTMP. In one embodiment, the tissue web comprises a first strength layer having cellulosic fibers and polyvinylamine, optionally further comprising a second compound which interacts with the polyvinylamine to modify strength properties or wetting properties of the web. The web further comprises a second high yield layer having at least 20% by weight high yield fibers and optional binder material such as synthetic fibers, including thermally bondable bicomponent binder fibers, resulting in a bulky multilayered structure having good strength properties. Related structures are disclosed in EP 1,039,027 and EP 851950B. In an alternative embodiment, the high yield layer has at least 0.3% by weight of a wet strength agent such as Kymene.

Dry airlaid webs can also be treated with polyvinylamine polymers. Airlaid webs can be formed by any method known in the art, and generally comprise entraining fiberized or comminuted cellulosic fibers in an air stream and depositing the fibers to form a mat. The mat may then be calendered or compressed, before or after chemical treatment using known techniques, including those of U.S. Pat. No. 5,948,507 to Chen et al., herein incorporated by reference.

Whether airlaid, wetlaid, or formed by other means, the web can be substantially free of latex and substantially free of film-forming compounds. The applied solution or slurry comprising polyvinylamine polymers and/or the complexing agent can also be free of formaldehyde or cross-linking agents that evolve formaldehyde.

The polyvinylamine polymer and complexing agent combination can be used in conjunction with any known materials and chemicals that are not antagonistic to its intended use. For example, when used in the production of fibrous materials in absorbent articles or other products, odor control agents may be present, such as odor absorbents, activated carbon fibers and particles, baby powder, baking soda, chelating agents, zeolites, perfumes or other odor-masking agents, cyclodextrin compounds, oxidizers, and the like. The absorbent article may further comprise metalphthalocyanine material for odor control, antimicrobial properties, or other purposes, including the materials disclosed in WO 01/41689, published Jun. 14, 2001 by Kawakami et al. Superabsorbent particles, fibers, or films may be employed. For example, an absorbent fibrous mat of comminuted fibers or an airlaid web treated with a polyvinylamine polymer may be combined with superabsorbent particles to serve as an absorbent core or intake layer in a disposable absorbent article such as a diaper. A wide variety of other compounds known in the art of papermaking and tissue production can be included in the webs of the present invention.

Debonders, such as quaternary ammonium compounds with alkyl or lipid side chains, can be used to provide high wet:dry tensile strength ratios by lowering the dry strength without a correspondingly large decrease in the wet strength. Softening compounds, emollients, silicones, lotions, waxes, and oils can also have similar benefits in reducing dry strength, while providing improved tactile properties such as a soft, lubricious feel. Fillers, fluorescent whitening agents, antimicrobials, ion-exchange compounds, odor-absorbers, dyes, and the like can also be added.

Hydrophobic matter added to selected regions of the web, especially the uppermost portions of a textured web, can be valuable in providing improved dry feel in articles intended for absorbency and removal of liquids next to the skin. The above additives can be added before, during, or after the application of the complexing agent (e.g., a polymeric reactive anionic compound) and/or a drying or curing step. Webs treated with polyvinylamine polymers may be further treated with waxes and emollients, typically by a topical application. Hydrophobic material can also be applied over portions of the web. For example, it can be applied topically in a pattern to a surface of the web, as described in Pat. No. 5,990,377, "Dual-Zoned Absorbent Webs," issued on Nov. 23, 1999, herein incorporated by reference.

When debonders are to be applied, any debonding agent (or softener) known in the art may be utilized. The debonders may include silicone compounds, mineral oil and other oils or lubricants, quaternary ammonium compounds with alkyl side chains, or the like known in the art. Exemplary debonding agents for use herein are cationic materials such as quaternary ammonium compounds, imidazolinium compounds, and other such compounds with aliphatic, saturated or unsaturated carbon chains. The carbon chains may be unsubstituted or one or more of the chains may be substituted, e.g. with hydroxyl groups. Non-limiting examples of quaternary ammonium debonding agents useful herein include hexamethonium bromide, tetraethylammonium bromide, lauryl trimethylammonium chloride, and dihydrogenated tallow dimethylammonium methyl sulfate.

The suitable debonders may include any number of quaternary ammonium compounds and other softeners known in the art, including but not limited to, oleylimidazolinium debonders such as C-6001 manufactured by Goldschmidt or Prosoft TQ-1003 from Hercules (Wilmington, Del.); Berocell 596 and 584 (quaternary ammonium compounds) manufactured by Eka Nobel Inc., which are believed to be made in accordance with U.S. Pat. Nos. 3,972,855 and 4,144,122; Adogen 442 (dimethyl dihydrogenated tallow ammonium chloride) manufactured by Cromtpon; Quasoft 203 (quaternary ammonium salt) manufactured by Quaker Chemical Company; Arquad 2HT75 (di(hydrogenated tallow) dimethyl ammonium chloride) manufactured by Akzo Chemical Company; mixtures thereof; and the like.

Other debonders can be tertiary amines and derivatives thereof; amine oxides; saturated and unsaturated fatty acids and fatty acid salts; alkenyl succinic anhydrides; alkenyl succinic acids and corresponding alkenyl succinate salts; sorbitan mono-, di- and tri-esters, including but not limited to stearate, palmitate, oleate, myristate, and behenate sorbitan esters; and particulate debonders such as clay and silicate fillers. Useful debonding agents are described in, for example, U.S. Pat. Nos. 3,395,708, 3,554,862, and 3,554,863 to Hervey et al., U.S. Pat. No. 3,775,220 to Freimark et al., U.S. Pat. No. 3,844,880 to Meisel et al., U.S. Pat. No. 3,916,058 to Vossos et al., U.S. Pat. No. 4,028,172 to Mazzarella et al., U.S. Pat. No. 4,069,159 to Hayek, U.S. Pat. No. 4,144,122 to Emanuelsson et al., U.S. Pat. No. 4,158,594 to Becker et al., U.S. Pat. No. 4,255,294 to Rudy et al., U.S. Pat. Nos. 4,314,001, 4,377,543 to Strolibeen et al., U.S. Pat. No. 4,432,833 to Breese et al., U.S. Pat. No. 4,776,965 to Nuesslein et al., and U.S. Pat. No. 4,795,530 to Soerens et al.

In one embodiment, a synergistic combination of a quaternary ammonium surfactant component and a nonionic surfactant is used, as disclosed in EP 1,013,825, published Jun. 28, 2000.

The debonding agent can be added at a level of at least about 0.1%, specifically at least about 0.2%, more specifically at least about 0.3%, on a dry fiber basis. Typically, the debonding agent will be added at a level of from about 0.1 to about 6%, more typically from about 0.2 to about 3%, active matter on dry fiber basis. The percentages given for the amount of debonding agent are given as an amount added to the fibers, not as an amount actually retained by the fibers.

Softening agents known in the art of tissue making may also serve as debonders or hydrophobic matter suitable for the present invention and may include but not limited to: fatty acids; waxes; quaternary ammonium salts; dimethyl dihydrogenated tallow ammonium chloride; quaternary ammonium methyl sulfate; carboxylated polyethylene; cocamide diethanol amine; coco betaine; sodium lauroyl sarcosinate; partly ethoxylated quaternary ammonium salt; distearyl dimethyl ammonium chloride; methyl-1-oleyl amidoethyl-2-oleyl imidazolinium methylsulfate (Varisoft 3690 from Witco Corporation, now Crompton in Middlebury, Conn.); mixtures thereof; and, the like known in the art.

Debonder and a PARC, or other complexing agent, can be used together with polyvinylamine polymers. The debonder can be added to the web in the furnish or otherwise prior to application of the PARC and subsequent crosslinking. However, debonder may also be added to the web after application of PARC solution and even after crosslinking of the PARC. In another embodiment, the debonder is present in the PARC solution and thus is applied to the web as the same time as the PARC, provided that adverse reactions between the PARC and the debonder are avoided by suitable selection of temperatures, pH values, contact time, and the like. PARC or any other additives can be applied heterogeneously using either a single pattern or a single means of application, or using separate patterns or means of application. Heterogeneous application of the chemical additive can be by gravure printing, spraying, or any method previously discussed.

Surfactants may also be used, being mixed with either the polyvinylamine polymer, the second compound (or complexing agent), or added separately to the web or fibers. The surfactants may be anionic, cationic, or non-ionic, including but not limited to: tallow trimethylammonium chloride; silicone amides; silicone amido quaternary amines; silicone imidazoline quaternary amines; alkyl polyethoxylates; polyethoxylated alkylphenols; fatty acid ethanol amides; dimethicone copolyol esters; dimethiconol esters; dimethicone copolyols; mixtures thereof; and, the like known in the art.

Charge-modifying agents can also be used. Commercially available charge-modifying agents include Cypro 514, produced by Cytec, Inc. of Stamford, Conn.; Bufloc 5031 and Bufloc 534, both products of Buckman Laboratories, Inc. of Memphis, Tenn. The charge-modifying agent can comprise low-molecular-weight, high charge density polymers such as polydiallyldimethylammonium chloride (DADMAC) having molecular weights of about 90,000 to about 300,000, polyamines having molecular weights of about 50,000 to about 300,000 (including polyvinylamine polymers) and polyethyleneimine having molecular weights of about 40,000 to about 750,000. After the charge-modifying agent has been in contact with the furnish for a time sufficient to reduce the charge on the furnish, a debonder is added. In accordance with the invention the debonder includes an ammonium surfactant component and a nonionic surfactant component as noted above.

In one embodiment, the paper webs of the present invention are laminated with additional plies of tissue or layers of nonwoven materials such as spunbond or meltblown webs, or other synthetic or natural materials.

The web may also be calendered, embossed, slit, rewet, moistened for use as a wet wipe, impregnated with thermoplastic material or resins, treated with hydrophobic matter, printed, apertured, perforated, converted to multiply assemblies, or converted to bath tissue, facial tissue, paper towels, wipers, absorbent articles, and the like.

The tissue products of the present invention can be converted in any known tissue product suitable for consumer use. Converting can comprise calendering, embossing, slitting, printing, addition of perfume, addition of lotion or emollients or health care additives such as menthol, stacking preferably cut sheets for placement in a carton or production of rolls of finished product, and final packaging of the product, including wrapping with a poly film with suitable graphics printed thereon, or incorporation into other product forms.

Acid Dyeing

Besides being used in paper webs for improving the strength properties of the webs, in another embodiment of the present invention, it has been discovered that the combination of a polyvinylamine polymer and a complexing agent, namely a polymeric anionic reactive compound, when applied to a textile material can increase the affinity of the material for various dyes, particularly acid dyes. The textile material can be any textile material containing cellulosic fibers. Such fibers include not only pulp fibers, but also cotton fibers, rayon fibers, hemp, jute, ramie, and other synthetic natural or regenerated cellulosic fibers, including lyocell materials. The textile materials being dyed can be in the form of fibers, yarns, or fabrics.

It is well known in the art that acid dyes are relatively ineffective in dyeing cellulosic substrates because the chemistry of the acid dyes does not make them readily substantive to the cellulosic material. It has been discovered by the present inventors, however, that once a cellulosic fiber has been treated with a complexing agent and a polyvinylamine polymer, the fiber becomes more receptive to acid dyes. Of particular advantage, fibers treated in accordance with the present invention can be mixed with other types of fibers and dyed resulting in a fabric having a uniform color. Specifically, in the past, because cellulosic fibers were not receptive to acid dyes, the cellulosic fibers did not dye evenly when mixed with other fibers, such as polyester fibers, nylon fibers, wool fibers, and the like. When treated in accordance with the present invention, however, cellulosic fibers can be mixed with other types of fibers and dyed in one process to produce fibers that all have about the same color and shade.

This embodiment of the present invention can also be used in connection with paper webs. For instance, once a paper web is treated with a complexing agent and a polyvinylamine polymer, the web can then be dyed to produce paper products having a particular color. Alternatively, a decorative pattern can be applied to the product using a suitable acid dye.

Although not wanting to be bound by any particular theory, it is believed that a complexing agent once contacting a cellulosic fiber will bind to the fiber. The complexing agent can be, for instance, a polymeric anionic reactive compound. Once the complexing agent is bound to the fiber, the complexing agent can facilitate the formation of a covalent bond between a polyvinylamine and the fiber. The polyvinylamine polymer provides dye sites for the acid dye.

Although not necessary, for most applications it is generally desirable to contact the cellulosic fibers with the complexing agent, such as a polymeric anionic reactive compound, prior to contacting the cellulosic fibers with the polyvinylamine polymer. The manner and methods used to contact the cellulosic fibers with the complexing agent and the polyvinylamine polymer can be any suitable method as described above. In this embodiment, each component can be applied to the cellulosic material in an amount from about 0.1% to about 10% by weight, and particularly from about 0.2% to about 6% by weight, and more particularly at about 4% by weight, based upon the weight of the cellulosic material. For most applications, smaller amounts of the complexing agent, such as the polymeric anionic reactive compound, should be used in order to leave free amine groups on the polyvinylamine polymer for binding with the acid dye. The amount of complexing agent added in relation to the polyvinylamine polymer can be determined for a particular application using routine experimentation.

In accordance with the present invention, cellulosic fibers or webs are treated with a complexing agent and a polyvinylamine polymer and then optionally cured at temperatures of at least about 120° C. and more particularly at temperatures of at least about 130° C. As stated above, the cellulosic material being dyed can be combined with non-cellulosic fibers and dyed or can be dyed first and then optionally combined with non-cellulosic fibers. The non-cellulosic fibers can be any suitable fiber for acid dyeing, such as wool, nylon, silk, other protein-based fibers, polyester fibers, synthetic polyamides, other nitrogen containing fibers, and the like.

Once treated in accordance with the present invention, the cellulosic material can be contacted with any suitable acid dye. Such acid dyes include pre-metallized acid dyes, pre-metallized acid nonionic solubilized dyes, pre-metallized acid asymmetrical monosulphonated dyes, and pre-metallized acid symmetrical dye-sulphonated/dicarboxylated dyes. It should be understood, however, that other acid dyes besides the dyes identified above can also be used.

For example, in one embodiment, the dye used in the process of the present invention can be an acid mordant dye. Such dyes include metallic mordant dyes, such as a chrome mordant dye.

In order to dye the cellulosic material, conventional dyeing techniques for the particular dye chosen can be used. In general, once contacted with a complexing agent and a polyvinylamine polymer in accordance with the present invention, the cellulosic material can be placed in a dye bath at a particular temperature and for a particular amount of time until the proper shade is obtained. For instance, in one embodiment, after pretreatment, the cellulosic material can be immersed in a dye bath containing an acid dye. Other auxiliary agents can also be contained in the bath, such as a chelated metal, which can be for instance, a multivalent transition metal such as chromium, cobalt, copper, zinc and iron.

As stated above, the conditions of dyeing would depend upon the specific nature of the acid dye used. For most applications, dyeing will take place at temperatures of from about 50° C. to about 100° C. and at a pH that is in the range of from about 5 to about 7. The concentration of the acid dye can be from about 0.1% to about 5% based upon the weight of the dry fiber. One method for dyeing textiles with an acid dye as disclosed in U.S. Pat. No. 6,200,354 to Collins, et al. which is incorporated herein by reference.

Recently it has been discovered that acidic dyes can act as bridges to link antimicrobial agents such as quaternary ammonium salts to synthetic fabrics. Such fabrics can maintain their antimicrobial properties after multiple washings. Such benefits are disclosed by Young Hee Kim and Gang Sun in the article "Durable Antimicrobial Finishing of Nylon Fabrics with Acid Dyes and a Quaternary Ammonium Salt," Textile Research Journal, Vol. 71, No. 4, pp. 318–323, April 2001. Based on the experimental findings in the present invention and the findings in the above referenced article, improved antimicrobial properties can be achieved for blends of conventional acid-dyeable fibers with modified cellulosic fibers treated according to the present invention to become acid dyeable. Thus, a blend of cellulosic fibers treated with a complexing agent and a polyvinylamine compound can blended with synthetic fibers such as nylon, or with wool fibers, silk fibers, and the like, and then treated with an acid dye and a quaternary ammonium compound such as a quaternary ammonium salt having antimicrobial properties. Such a blend can not only have excellent color uniformity and colorfastness, now that the cellulose has been modified to be acid-dyeable, but the cellulosic fibers as well as other fibers in the blend can have washfast antimicrobial properties. Alternatively, if the quaternary ammonium compound is a softening agent, including any of the myriad of such compounds known in the art, then the blend treated with the softening agent can have improved tactile properties that persist after washing.

Kim and Sun in the above referenced article disclose treating fibers with acid dyes at levels of from 0.125 to 2% based on fabric weight. Acid dyes used in their study include Red 18, Blue 113, and Violet 7. Acid Red 88 was also used. They used N-(3-chloro-2-hydroxylpropyl)-N,N-dimethyldodecylammoniumchloride as the ammonium salt. It was applied in solutions with concentrations ranging from 1% to 8%, and the treated fabrics had add-on levels by weight from about 0% to slightly more than 2.1%. Fabrics were typically cured at 150° C. for 10 minutes, though a range from 100° C. to 150° C. was explored, with improved washing durability reported for higher temperature curing. Curing times were explored from 5 minutes to 15 minutes. Fabrics treated with over 4% concentration ammonium salt solution showed over 90% reduction in *E. coli* bacteria counts even after Launder-Ometer 10 washings. Fabrics dyed in too high a dye concentration (e.g., 3% or greater) lost some antimicrobial action, presumably due to saturation of amorphous regions of the nylon fibers with dye molecules, preventing further access of the ammonium salt into the fibers. Thus, in one embodiment, the concentration of the acid dye in solution when applied to the fibers can be less than 3 wt. %, specifically less than 2 wt %, more specifically less than 1 wt. %, and most specifically less than about 0.5 wt. %, with exemplary ranges of from about 0.01 wt. % to about 1.5 wt. %, or from about 0.1 wt. % to about 1 wt. %.

Beside acid dyes and/or antimicrobial agents, cellulosic materials treated with a polyvinylamine and a complexing agent in accordance with the present invention can be more receptive to other finishing treatments. For instance, cellulosic materials treated in accordance with the present invention can have a greater affinity for silicone compounds, such as amino-functional polysiloxanes, including those disclosed in U.S. Pat. No. 6,201,093, which is incorporated herein by reference. Such polysiloxanes soften fabrics and cellulosic webs. Such finishing treatments can be especially desirable when treated cellulosic fibers are combined with other fibers to provide a woven or nonwoven textile web, before or after dyeing or without dyeing, that has uniform properties. Applying polysiloxanes in accordance with the present invention, however, can also be done to paper webs, especially tissues for increasing the softness of the product.

Other silicone compounds that can be used include organofunctional, hydrophilic, and/or anionic polysiloxanes for improved immobilization and fastness of the polysiloxane or other silicone compound. Exemplary organofunctional or anionic polysiloxanes are disclosed in U.S. Pat. No. 4,137,360, issued Jan. 30, 1979 to Reischl; U.S. Pat. No. 5,614,598, issued Mar. 25, 1997 to Barringer and Ledford; and other compounds known in the art.

Other useful silicone compounds include silicone-based debonders, antistatic agents, softness agents, surface active agents, and the like, many of which can be obtained from Lambent Technologies, Inc., as described by A. J. O'Lenick, Jr., and J. K. Parkinson, in "Silicone Compounds: Not Just Oil Phases Anymore," Soap/Cosmetics/Chemical Specialties, Vol. 74, No. 6, June 1998, pp. 55–57. Exemplary silicone compounds include silicone quats such as silicone alkylamido quaternary compounds based on dimethicone copolyol chemistry, which can be useful as softeners, antistatic agents, and debonders; silicone esters, including phosphate esters which can provide lubricity or other functions, such as the esters disclosed in U.S. Pat. No. 6,175,028; dimethiconol stearate and dimethicone copolyol isostearate, which is highly lubricious and can be applied as microemulsion in water; silicone copolymers with polyacrylate, polyacrylamide, or polysulfonic acid; silicone iethioniates; silicone carboxylates; silicone sulfates; silicone sulfosuccinates; silicone amphoterics; silicone betaines; and silicone imidazoline quats. Related patents describing such compounds including the following: U.S. Pat. Nos. 5,149,765; 4,960,845; 5,296,434; 4,717,498; 5,098,979; 5,135,294; 5,196,499; 5,073,619; 4,654,161; 5,237,035; 5,070,171; 5,070,168; 5,280,099; 5,300,666; 4,482,429; 4,432,833 (which discloses hydrophilic quaternary amine debonders) and U.S. Pat. No. 5,120,812, all of which are herein incorporated by reference. Hydrophilic debonders may be applied at the same doses and in a similar manner as hydrophobic debonders. In general, silicone compounds can be applied to webs that also comprise polyvinylamine compounds, whether the compounds interact directly with the polyvinylamine or not. As one example, methods of producing tissue containing cationic silicone are disclosed in U.S. Pat. No. 6,030,675, issued Feb. 29, 2000 to Schroeder et al., herein incorporated by reference.

Definitions and Test Methods

As used herein, a material is said to be "absorbent" if it can retain an amount of water equal to at least 100% of its dry weight as measured by the test for Intrinsic Absorbent Capacity given below (i.e., the material has an Intrinsic Absorbent Capacity of at about 1 or greater). For example, the absorbent materials used in the absorbent members of the present invention can have an Intrinsic Absorbent Capacity of about 2 or greater, more specifically about 4 or greater, more specifically still about 7 or greater, and more specifically still about 10 or greater, with exemplary ranges of from about 3 to about 30 or from about 4 to about 25 or from about 12 to about 40.

As used herein, "high yield pulp fibers" are those papermaking fibers of pulps produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. High yield pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers can have lignin content by mass of about 1% or greater, more specifically about 3% or greater, and still more specifically from about 2% to about 25%. Likewise, high yield fibers can have a kappa number greater than 20, for example. In one embodiment, the high-yield fibers are predominately softwood, such as northern softwood or, more specifically, northern softwood BCTMP.

As used herein, the term "cellulosic" is meant to include any material having cellulose as a major constituent, and specifically comprising about 50 percent or more by weight of cellulose or cellulose derivatives. Thus, the term includes cotton, typical wood pulps, nonwoody cellulosic fibers, cellulose acetate, cellulose triacetate, rayon, viscose fibers, thermomechanical wood pulp, chemical wood pulp, debonded chemical wood pulp, lyocell and other fibers formed from solutions of cellulose in NMMO, milkweed, or bacterial cellulose. Fibers that have not been spun or regenerated from solution can be used exclusively, if desired, or at least about 80% of the web can be free of spun fibers or fibers generated from a cellulose solution.

As used herein, the "wet:dry ratio" is the ratio of the geometric mean wet tensile strength divided by the geometric mean dry tensile strength. Geometric mean tensile strength (GMT) is the square root of the product of the machine direction tensile strength and the cross-machine direction tensile strength of the web. Unless otherwise indicated, the term "tensile strength" means "geometric mean tensile strength." The absorbent webs used in the present invention can have a wet:dry ratio of about 0.1 or greater and more specifically about 0.2 or greater. Tensile strength can be measured using an Instron tensile tester using a 3-inch jaw width (sample width), a jaw span of 2 inches (gauge length), and a crosshead speed of 25.4 centimeters per minute after maintaining the sample under TAPPI conditions for 4 hours before testing. The absorbent webs of the present invention can have a minimum absolute ratio of dry tensile strength to basis weight of about 0.01 gram/gsm, specifically about 0.05 grams/gsm, more specifically about 0.2 grams/gsm, more specifically still about 1 gram/gsm and most specifically from about 2 grams/gsm to about 50 grams/gsm.

As used herein, "bulk" and "density," unless otherwise specified, are based on an oven-dry mass of a sample and a thickness measurement made at a load of 0.34 kPa (0.05 psi) with a 7.62-cm (three-inch) diameter circular platen. Details for thickness measurements and other forms of bulk are described hereafter. As used herein, "Debonded Void Thickness" is a measure of the void volume at a microscopic level along a section of the web, which can be used to discern the differences between densified and undensified portions of the tissue or between portions that have been highly sheared and those that have been less sheared. The test method for measuring "Debonded Void Thickness" is described in U.S. Pat. No. 5,411,636, "Method for Increasing the Internal Bulk of Wet-Pressed Tissue," issued May 2, 1995, to Hermans et al., herein incorporated by reference in its entirety. Specifically, Debonded Void Thickness is the void area or space not occupied by fibers in a cross-section of the web per unit length. It is a measure of internal web bulk (as distinguished from external bulk created by simply molding the web to the contour of the fabric). The "Normalized Debonded Void Thickness" is the Debonded Void Thickness divided by the weight of a circular, four inch diameter sample of the web. The determination of these parameters is described in connection with FIGS. 8–13 of U.S. Pat. No. 5,411,636. Debonded Void Thickness reveal some aspects of asymmetrically imprinted or molded tissue. For example, Debonded Void Thickness, when adapted for measurement of a short section of a protrusion of a molded web by using a suitably short length of a cross-directional cross-section, can reveal that the leading side of a protrusion has a different degree of bonding than the trailing side, with average differences of about 10% or more or of about 30% or more being contemplated. As used herein, "elastic modulus" is a measure of slope of stress-strain of a web taken during tensile testing thereof and is expressed in units of kilograms of force. Tappi conditioned samples with a width of 3 inches are placed in tensile tester jaws with a gauge length (span between jaws) of 2 inches. The jaws move apart at a crosshead speed of 25.4 cm/min and the slope is taken as the least squares fit of the data between stress values of 50 grams of force and 100 grams of force, or the least squares fit of the data between stress values of 100 grams of force and 200 grams of force, whichever is greater. If the sample is too weak to sustain a stress of at least 200 grams of force without failure, an additional ply is repeatedly added until the multi-ply sample can withstand at least 200 grams of force without failure.

As used herein, the term "hydrophobic" refers to a material having a contact angle of water in air of at least 90 degrees. In contrast, as used herein, the term "hydrophilic" refers to a material having a contact angle of water in air of less than 90 degrees. As used herein, the term "surfactant" includes a single surfactant or a mixture of two or more surfactants. If a mixture of two or more surfactants is employed, the surfactants may be selected from the same or different classes, provided only that the surfactants present in the mixture are compatible with each other. In general, the surfactant can be any surfactant known to those having ordinary skill in the art, including anionic, cationic, nonionic and amphoteric surfactants. Examples of anionic surfactants include, among others, linear and branched-chain sodium alkylbenzenesulfonates; linear and branched-chain alkyl sulfates; linear and branched-chain alkyl ethoxy sulfates; and silicone phosphate esters, silicone sulfates, and silicone carboxylates such as those manufactured by Lambent Technologies, located in Norcross, Ga. Cationic surfactants include, by way of illustration, tallow trimethylammonium chloride and, more generally, silicone amides, silicone amido quaternary amines, and silicone imidazoline quaternary amines. Examples of nonionic surfactants, include, again by way of illustration only, alkyl polyethoxylates; polyethoxylated alkylphenols; fatty acid ethanol amides; dimethicone copolyol esters, dimethiconol esters, and dimethicone copolyols such as those manufactured by Lambent Technologies; and complex polymers of ethylene oxide, propylene oxide, and alcohols. One exemplary class of amphoteric surfactants are the silicone amphoterics manufactured by Lambent Technologies (Norcross, Ga.).

As used herein, "softening agents," sometimes referred to as "debonders," can be used to enhance the softness of the tissue product and such softening agents can be incorporated with the fibers before, during or after disperging. Such agents can also be sprayed, printed, or coated onto the web after formation, while wet, or added to the wet end of the tissue machine prior to formation. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di-hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

EXAMPLES

Preparation of Handsheets

To prepare a pulp slurry, 24 grams (oven-dry basis) of pulp fibers are soaked for 24 hours. The wet pulp is placed in 2 liters of deionized water and then disintegrated for 5 minutes in a British disintegrator. The slurry is then diluted with deionized water to a volume of 8 liters. From 900 ml to 1000 ml of the diluted slurry, measured in a graduated cylinder, is then poured into an 8.5-inch by 8.5-inch Valley handsheet mold (Valley Laboratory Equipment, Voith, Inc.) that is half-filled with water. After pouring slurry into the mold, the mold is then completely filled with water, including water used to rinse the graduated cylinder. The slurry is then agitated gently with a standard perforated mixing plate that is inserted into the slurry and moved up and down seven times, then removed. The water is then drained from the mold through a wire assembly at the bottom of the mold which retains the fibers to form an embryonic web. The forming wire is a 90×90 mesh, stainless-steel wire cloth. The web is couched from the mold wire with two blotter papers placed on top of the web with the smooth side of the blotter contacting the web. The blotters are removed and the embryonic web is lifted with the lower blotter paper, to which it is attached. The lower blotter is separated from the other blotter, keeping the embryonic web attached to the lower blotter. The blotter is positioned with the embryonic web face up, and the blotter is placed on top of two other dry blotters. Two more dry blotters are also placed on top of the embryonic web. The stack of blotters with the embryonic web is placed in a Valley hydraulic press and pressed for one minute with 75 psi applied to the web. The pressed web is removed from the blotters and placed on a Valley steam dryer containing steam at 2.5 psig pressure and heated for 2 minutes, with the wire-side surface of the web next to the metal drying surface and a felt under tension on the opposite side of the web. Felt tension is provided by a 17.5 lbs of weight pulling downward on an end of the felt that extends beyond the edge of the curved metal dryer surface. The dried handsheet is trimmed to 7.5 inches square with a paper cutter and then weighed in a heated balance with the temperature maintained at 105° C. to obtain the oven dry weight of the web.

The percent consistency of the diluted pulp slurry from which the sheet is made is calculated by dividing the dry weight of the sheet by the initial volume (in terms of milliliters, ranging from 900 to 1000) and multiplying the quotient by 100. Based on the resulting percent consistency value, the volume of pulp slurry necessary to give a target sheet basis weight of 60 gsm (or other target value) is calculated. The calculated volume of diluted pulp is used to make additional handsheets.

The above procedure is the default handsheet procedure that was used unless otherwise specified. Several trials, hereafter specified, employed handsheets made with an alternate but similar procedure (hereafter the "alternate handsheet procedure") in which 50 grams of fibers are soaked for 5 minutes in 2 liters of deionized water prior to disintegration in the British disintegrator as specified above. The slurry was then diluted with deionized water to a volume of 8 liters. A first chemical (if used) was then added to the low consistency slurry as a dilute (1.0%) solution. The slurry was mixed with a standard mechanical mixer at moderate shear for 10 minutes after addition of the first chemical. A second chemical (if used) was then added and mixing continued for an additional 2–5 minutes. All stages experienced a substantially constant agitation level. Handsheets were made with a target basis weight of about 60 gsm, unless otherwise specified. During handsheet formation, the appropriate amount of fiber slurry (0.625% consistency) required to make a 60 gsm sheet was measure into a graduated cylinder. The slurry was then poured from the graduated cylinder into an 8.5-inch by 8.5-inch Valley handsheet mold (Valley Laboratory Equipment, Voith, Inc.) that had been prefilled to the appropriate level with water. Web formation and drying is done as described in the default handsheet method described above, with the exception that the wet web in the Valley hydraulic press was pressed for one minute at 100 psi instead of 75 psi.

Tensile Tests

Handsheet testing is done under laboratory conditions of 23.0+/−1.0° C., 50.0+/−2.0% relative humidity, after the sheet has equilibrated to the testing conditions for four hours. The testing is done on a tensile testing machine maintaining a constant rate of elongation, and the width of each specimen tested is 1 inch. The specimen are cut into strips having a 1±0.04 inch width using a precision cutter. The "jaw span" or the distance between the jaws, sometimes referred to as gauge length, is 5.0 inches. The crosshead speed is 0.5 inches per minute (12.5 mm/min.) A load cell is chosen so that peak load results generally fall between about 20 and about 80 percent of the full scale load (e.g., a 100N load cell). Suitable tensile testing machines include those such as the Sintech QAD IMAP integrated testing system or an MTS Alliance RT/1 universal test machine with TestWorks 4 software. This data system records at least 20 load and elongation points per second.

Wet Tensile Strength

For wet tensile measurement, distilled water is poured into a container to a depth of approximately ¾ of an inch. An open loop is formed by holding each end of a test specimen and carefully lowering the specimen until the lowermost curve of the loop touches the surface of the water without allowing the inner side of the loop to come together. The lowermost point of the curve on the handsheet is contacted with the surface of the distilled water in such a way that the wetted area on the inside of the loop extends at least 1 inch and not more than 1.5 inches lengthwise on the specimen and is uniform across the width of the specimen. Care is taken to not wet each specimen more than once or allow the opposite sides of the loop to touch each other or the sides of the container. Excess water is removed from the test specimen by lightly touching the wetted area to a blotter. Each specimen is blotted only once. Each specimen is then immediately inserted into the tensile tester so that the jaws are clamped to the dry area of the test specimen with the wet area approximately midway between the span. The test specimen are tested under the same instrument conditions and using same calculations as for Dry Tensile Strength measurements.

Soluble Charge Testing

Soluble charge testing is done with an ECA 2100 Electrokinetic Charge Analyzer from ChemTrac (Norcross, Ga.). Titration is done with a Mettler DL21 Titrator using 0.001N DADMAC (diallyl dimethyl ammonium chloride) when the sample is anionic, or 0.001N PVSK (potassium polyvinyl sulphate) when the sample is cationic. 500 ml of the pulp slurry prepared for use in handsheet making (slurry having about 1.5 g of fibers) is dewatered on a Whatman No. 4 filter on a Buechner funnel. Approximately 150 ml of filtrate (the exact weight to 0.01 grams is recorded for soluble charge calculations) is withdrawn and used to complete the titration. The streaming potential (streaming current) of the filtrate is then measured after 5 to 10 minutes, once the reading has stabilized. The sign of the streaming potential is then used to determine which reagent to apply in titration. The titration is complete when the current reaches zero. Soluble charge is calculated using the titrant normality (0.001N), titrant volume consumed, and filtrate weight; soluble charge is reported in units of milliequivalents per liter (meq/L).

Example 1

The strength benefits of polyvinylamine were explored with application to an uncreped through-dried tissue having a basis weight of 43 gsm, generally made according to the uncreped through-air dried method as disclosed in U.S. Pat. No. 5,048,589 to Cook et al. The tissue was made from a 50/50 blend of Fox River RF recycled fibers and Kimberly-Clark Mobile wet lap bleached kraft softwood fibers (Mobile, Ala.). The fibers were converted to a dilute slurry of about 0.5% consistency and formed into a web onto a pilot paper machine operating at 40 feet per minute. The embryonic web was dewatered by foils and vacuum boxes to about 18% consistency, whereupon the web was transferred to a through drying fabric with 15% rush transfer, meaning that the through drying fabric traveled at a velocity 15% less than the forming wire and that the differential velocity transfer occurred over a vacuum pickup shoe, as described in U.S. Pat. No. 5,667,636 to Engel et al. Through drying was done on a 44 GST through-drying fabric from AstenJohnson Company (Charleston, S.C.). No wet strength agents were added, resulting in a sheet with minimal wet strength. The tissue was cut to either 5-inch by 8-inch rectangles each having a weight of about 1.2 grams (room conditions of 30% RH and 73° F.) or to 8-inch by 8-inch rectangles with a dry mass of about 1.85 grams.

The cut tissues were treated in six different trials, labeled A through F and described below. In these trials, the polymeric anionic reactive compound used was BELCLENE® DP80 (Durable Press 80), a terpolymer of maleic anhydride, vinyl acetate, and ethyl acetate from FMC Corporation. This was prepared as a 1% by weight aqueous solution in deionized water. The PARC solution also included sodium hypophosphite (SHP) as a catalyst, with one part of SHP for each two parts by weight of polymeric reactive compound (i.e., 0.5% SHP).

The polyvinylamine compound used was either Catiofast® PR 8106 or Catiofast® PR 8104, both by BASF (Ludwigshafen, Germany), each diluted with deionized water to form an 0.5 wt % solution. These compounds include forms of polyvinylformamide which have been hydrolyzed to various extents to convert the formamide groups to amine groups on a polyvinyl backbone. Catio-Fast® 8106 is about 90% hydrolyzed and Catiofast 8104 is about 10% hydrolyzed.

In the following trials, application of solutions to the web was done by spraying both sides of the web with a spray of the solution generated by a hand-held spray bottle.

Trial A: 2.9 g of PARC solution were added to a 5-inch by 8-inch tissue web for a PARC add-on level of 2.5% on a dry solids basis (PARC solids mass/dry fiber mass*100%). The moist web was dried and cured in a convection oven at 160° C. for 13 minutes. No polyvinylamine was added.

Trial B: 1.25 g of PARC solution were added to a 5-inch by 8-inch tissue web for a PARC add-on level of 1.1% on a dry solids basis. The moist web was then sprayed with 2.7 g of Catiofast® 8106 solution for a polyvinylamine add-on of 1.2% on a dry solids basis (polyvinylamine solids mass/dry fiber mass×100%). The moist web was dried and cured in a convection oven at 160° C. for 18 minutes.

Trial C: 2.85 g of Catiofast® 8106 solution were added to a 5-inch by 8-inch tissue web for a polyvinylamine add-on level of 2.5% on a dry solids basis. The moist web was then sprayed with 0.6 g of PARC solution for a PARC add-on of 0.26% on a dry solids basis (polyvinylamine solids mass/dry fiber mass*100%). The moist web was dried and cured in a convection oven at 160° C. for 16 minutes.

Trial D: 4.54 g of Catiofast® 8106 solution were added to a 5-inch by 8-inch tissue web for a polyvinylamine add-on level of 4.0% on a dry solids basis. No PARC solution was added. The moist web was dried and cured in a convection oven at 160° C. for about 20 minutes.

Trial E: 3.78 g of Catiofast® 8104 solution were added to a 5-inch by 8-inch tissue web for a polyvinylamine add-on level of 3.3% on a dry solids basis. No PARC solution was added. The moist web was dried and cured in a convection oven at 160° C. for 20 minutes.

Trial F: 2.65 g of PARC solution were added to a 8-inch by 8-inch tissue web for a PARC add-on level of 1.5% on a dry solids basis. The moist web was then sprayed with 3.96 g of Catiofast® 8104 solution for a polyvinylamine add-on of 1.1% on a dry solids basis. The moist web was then dried and cured in a convection oven at 160° C. for about 20 minutes.

Samples were tested in a conditioned Tappi laboratory (50% RH, 73° F.) for CD wet tensile strength using an MTS Alliance RT/1 universal testing machine running with TestWorks® 4 software, version 4.04 c. Testing was done with 3-inch wide sample strips cut in the cross-direction, mounted between pneumatically loaded rubber-surfaced grips with a 3-inch gauge length (span between upper and lower grips) and a crosshead speed of 10 inches per minute. For wet tensile testing, the sample strips were bent into a U-shape to allow the central portion of the strip to be immerse in deionized water. The sample with the central wet region was then mounted in the grips such that the grips did not contact wet portions of the tissue, whereupon the tensile test commenced. Delay time from immersion of the central portion of the sample to initiation of crosshead motion was about 6 seconds. Results are shown in Table 1. (Two tests were conducted for Trial A, but the first test was with a gauge length of 2 inches instead of 3 inches as used for all other trials. Though not reported in Table 1, the resulting value for CD wet tensile was 1330 g/3 in with a stretch of 6.4%.) Results reported include the wet tensile strength, with units of grams per 3-inches sample width; percent stretch at peak load; and TEA or total energy absorbed with units of centimeters-grams of force per square centimeter.

TABLE 1

CD Wet Tensile Results for Example 1.

| Sample | Wet Tensile, g/3 in | Stretch, % | TEA |
|---|---|---|---|
| untreated tissue | 102 | NA | 1.085 |
| Trial A | 1329 | 4.98 | 6.78 |
| Trial B | 1069 | 3.82 | 4.15 |

TABLE 1-continued

CD Wet Tensile Results for Example 1.

| Sample | Wet Tensile, g/3 in | Stretch, % | TEA |
|---|---|---|---|
| Trial B | 804 | 3.98 | 4.37 |
| Trial C | 737 | 5.08 | 4.48 |
| Trial C | 696 | 6.06 | 5.54 |
| Trial D | 921 | 7.31 | 7.39 |
| Trial D | 877 | 6.94 | 6.36 |
| Trial E | 171 | 4.27 | 1.58 |
| Trial E | 149 | 3.34 | 1.04 |
| Trial F | 663 | 4.15 | 3.31 |
| Trial F | 548 | 4.07 | 2.93 |

When wetted, the tissue from Trial C had a spotted appearance showing scattered regions that did not wet. It was hypothesized that an interaction of the two compounds, the PARC and the polyvinylamine, resulting in a sizing effect, though apparently the spray application was not sufficiently uniform to have a uniform sizing effect across the tissue. The results with a more uniform application of the two compounds are explored in Example 2 below.

Example 2

The untreated tissue and the solutions of Example 1 were employed again to explore the generation of hydrophobic properties associated with Trial C. In this example, however, the tissue was treated with a uniform application of both compounds simultaneously. The polyvinylamine solution was directly mixed with the PARC solution prior to application to the tissue. Thus, 5 ml of 0.5% Catiofast® PR 8106 were mixed at 73° F. with 5 ml of the PARC solution. The solution rapidly became cloudy, as if a colloidal suspension had formed. A similar mixture was also prepared using 5 ml of 0.5% Catiofast® PR 8104 which were mixed with 5 ml of the PARC solution. This second mixture remained clear. It is believed that the more highly hydrolyzed Catiofast® PR 8106 solution formed polyelectrolyte complexes with the anionic polymer that created a colloidal suspension.

The two mixtures were then applied to separate regions of another 8-inch by 8-inch tissue sample. The cloudy mixture of Catiofast® PR 8106 with PARC solution was applied dropwise to a portion of the sheet until 2.78 ml had been applied to a region about 7-cm in diameter. The clear mixture of Catiofast® PR 8104 with PARC solution was also applied dropwise to a remote portion of the tissue until 1 ml had been added. The tissue web with two distinct wetted areas was then placed in a convection oven at 160° C. for 5 minutes, where it was dried and cured. The dried tissue was then wetted by pouring tap water onto the web. The region that had been treated with the clear mixture of Catiofast® PR 8104 with PARC solution wetted easily. The region that had been treated with the cloudy mixture of Catiofast® PR 8106 with PARC solution was highly hydrophobic and did not wet at all, maintaining a dry appearance while the surrounding regions of the web wetted readily. The unwettable region maintained high strength in spite of its exposure to water. Squeezing the sized region between fingers did succeed in driving water into the web and giving it a wetted appearance in the squeezed regions.

Example 3

Sections of the tissue used in Example 1 were treated with aqueous solutions of 0.5% Catiofast® PR 8106 (a polyvinylamine) and/or PARC (0.5% of DP80 with 0.25% of sodium hypophosphite) or mixtures thereof. Three mixtures of the polyvinylamine and PARC were prepared with ratios of 30:70, 50:50, and 70:30. For each trial, 5 tissue samples were cut into 5-inch by 8-inch rectangles, with the 8-inch dimension being in the cross direction of the web. Most of the trials comprised spraying a total mass of treatment solution(s) having 350% of the dry mass of the web (relative to the web at room conditions, with about 5% moisture already in the "dry" web in a room with a relative humidity of about 30% and a temperature of about 72° F.). In some trials, a mixture of the PARC and polyvinylamine was applied to the web. In other trials, both compounds were applied separately. In the latter case, trials were conducted in which either the PARC or the polyvinylamine were applied first. At that point, the web was dried in some cases and not dried in others before applying the other solution, followed by drying and, in most cases, curing. Some cases were run with only one of the two compounds applied, no applied compound, or deionized water only applied to the web.

In these trials, drying of the web occurred during a 20-minute dwell time in a convection oven at 105° C. Curing occurred was placing the dried sample in a convection oven at 160° C. for 3 minutes.

The pH of the various solutions were checked with an Orion Research™ Model 611 digital pH/millivolt meter. The PARC solution had a pH of 3.28. The polyvinylamine solution (0.5% Catiofast® PR 8106) had a pH of 7.30. The 30:70 mixture of PARC and polyvinylamine (30 parts PARC solution and 70 parts polyvinylamine solution) had a pH of 4.32. The 50:50 mixture of PARC and polyvinylamine had a pH of 3.90, and the 70:30 mixture of PARC and polyvinylamine had a pH of 3.50.

Spraying was performed with a Paasche® Model VL Airbrush Set (Paasche Airbrush Company, Harwood Heights, Ill.). Solutions were sprayed with the airbrush on both sides of the sample until the required mass was applied, seeking to apply each solution uniformly and equally divided between the two sides of the web. When spraying, a back and forth sweeping motion was used, with spray extended past the edges of the sheet to avoid over-saturation on the return strokes. The sheet was turned after one side was sprayed, and the second side sprayed. The spray and turn sequence was repeated a number of times, until desired amount of wet pick-up was measured. The sample was manually transferred to a balance to determine % weight gain. Prior to replacing the sheet on a spraying surface after turning or replacing a sample, care was taken no to allow previously applied over-spray to contact the web and cause some portions to be excessively wetted.

The trials for the Example are listed in Table 2 below, showing the first solution (Soln. #1) applied to the web and its add-on level, and the second solution (if any) applied (listed as Soln. #2), with its add-on level. The polyvinylamine is designated as "polyvinylamine." Information about the treatment sequence is also provided. The treatments applied to the samples of any trial comprised the steps of spraying the compound(s), drying, and curing. The digits ranging from 1 to 5 in the treatment sequences columns labeled "Spray," "Dry," and "Cure" indicate the step number of the respective treatment, if it was applied. Thus, for example, in trial G1, the treatment sequence comprised the following five steps in order:

1. Spraying of Solution 1 (PARC) onto the sample. (Listed as "1" under the column "Spray.")
2. Drying of the wetted sample. (Listed as "2" under the column "Dry.")
3. Spraying of Solution 2 (polyvinylamine) onto the sample. (Listed as "3" under the column "Spray.")
4. Drying the wetted sample again. (Listed as "4" under the column "Dry.")
5. Curing the dried sample. (Listed as "5" under the column "Cure.")

Also listed in Table 2 are the intake times required for the sample to receive water either from a standard 25-microliter glass pipette ("25-μl Pipette Intake Time") or from a single drop of water applied by a disposable pipette.

In the test with the 25-microliter glass pipette, the pipette was filled with deionized water and the operator's finer was placed over the end of the pipette to prevent water from escaping. The opposite end of the vertically oriented pipette was then placed in contact with the sample as the sample was resting on a 1-inch diameter ring to prevent contact between the sample and the underlying tabletop. As the pipette contacted the web, the finger sealing one end of the pipette was released to permit wicking of the liquid from the pipette into the sample. The time in seconds required for the pipette to be emptied into the sample was then recorded. If no fluid intake occurred after 60 seconds, a score of "60+" was recorded. Three measurements were made for each trial, and the mean was reported, or, if one or two of the tests gave an intake time of "60+," the range was reported. Standard deviations are reported for sets of data lacking scores of "60+."

In the intake test with single water drops, a disposable plastic pipette was used to apply drops having a volume of about 0.03 to 0.04 ml onto the surface of the sample. A pendant drop was formed by gently squeezing the pipette until the drop was near the point of falling. The drop was then gently released onto the surface of the web, such that the drop contacted the web at about the same time as contact with the pipette was broken.(Downward momentum from falling was minimized.) The time in seconds required for the drop to be completely absorbed into the web was then recorded, with complete absorption being defined as the time when there was no longer a glossy body of water visible on the surface of the web where the drop had been placed. If the volume of the drop residing above the web had not appreciably decreased after 60 seconds, a score of "60+" was recorded. If there had been significant intake of the drop at 60 seconds, more time would be allowed to pass to observe the completion of intake. If there had been noticeable intake after 60 seconds but intake was still incomplete after 6 minutes, a score of "59+" was recorded. Three measurements were made for each trial, and the mean was reported, or, if one or two of the tests gave an intake time of "59+" or "60+," the range was reported. Standard deviations are reported for sets of data lacking scores of "59+" or "60+." The untreated control R1 and trial J1 gave extremely rapid intakes and are listed as simply <1 second.

TABLE 2

Trial Definitions and Water Intake Times.

| Trial | Soln. #1 | Add-On wt. % | Soln. #2 | Add-On wt. % | Treat. Sequence Spray | Dry | Cure | 25-μl Intake Time, seconds Mean or Range, | St. Dev. | Water Drop Intake Time, sec. Mean or Range, | St. Dev. |
|---|---|---|---|---|---|---|---|---|---|---|---|
| G1 | PARC | 100 | poly-vinyl-amine | 250 | 1,3 | 2,4 | 5 | 58–60+ | | 140–60+ | |
| G2 | " | " | " | " | 1,3 | 2,4 | — | 37–60+ | | 61–59+ | |
| H1 | PARC | 175 | poly-vinyl-amine | 175 | 1,3 | 2,4 | 5 | 60+ | | 60+ | |
| H2 | " | " | " | " | 1,3 | 2,4 | — | 60+ | | 60+ | |
| H3 | " | " | " | " | 1,2 | 3 | 4 | 60+ | | 59+ | |
| H4 | " | " | " | " | 1,2 | 3 | — | 60+ | | 59+ 60+ | |
| I1 | PARC | 250 | poly-vinyl-amine | 100 | 1,3 | 2,4 | 5 | 60+ | | 60+ | |
| I2 | " | " | " | " | 1,3 | 2,4 | — | 60+ | | 60+ | |
| J1 | PARC | 350 | — | | 1 | 2 | 3 | 4.44 | 0.61 | <1 | |
| J2 | " | " | " | " | 1 | 2 | — | 4.03 | 0.58 | 2.71 | 1.69 |
| K1 | poly-vinyl-amine | 100 | PARC | 250 | 1,3 | 2,4 | 5 | 9.28 | 1.56 | 6.96 | 0.99 |
| K2 | " | " | " | " | 1,3 | 2,4 | — | 8.62 | 3.51 | 3.33 | 2.37 |
| L1 | poly-vinyl-amine | 175 | PARC | 175 | 1,3 | 2,4 | 5 | 34.88 | 3.12 | 106 | 49.6 |
| L2 | " | " | " | " | 1,3 | 2,4 | — | 6.53 | 2.21 | 4.06 | 1.17 |
| L3 | " | " | " | " | 1,2 | 3 | 4 | 60+ | | 60+ | |
| L4 | " | " | " | " | 1,2 | 3 | — | 60+ | | 60+ | |
| M1 | poly-vinyl-amine | 250 | PARC | 100 | 1,3 | 2,4 | 5 | 13.00 | 3.54 | 28.27 | 15.26 |
| M2 | " | " | " | " | 1,3 | 2,4 | — | 15.29 | 8.82 | 7.42 | 5.62 |
| N1 | poly-vinyl-amine | 350 | — | | 1 | 2 | 3 | 11.02 | 2.95 | 12.17 | 2.64 |
| N2 | " | " | " | " | 1 | 2 | — | 13.53 | 1.05 | 8.17 | 2.24 |
| O1 | 30/70 PARC/poly-vinyl-amine | 350 | — | | 1 | 2 | 3 | 60+ | | 60+ | |
| O2 | " | " | " | " | 1 | 2 | — | 60+ | | 60+ | |
| P1 | 50/50 PARC/poly-vinyl-amine | 350 | — | | 1 | 2 | 3 | 60+ | | 60+ | |
| P2 | " | " | " | " | 1 | 2 | — | 60+ | | 60+ | |
| Q1 | 70/30 PARC/poly-vinyl-amine | 350 | — | | 1 | 2 | 3 | 60+ | | 60+ | |
| Q2 | " | " | " | " | 1 | 2 | — | 60+ | | 60+ | |
| R1 | Control | — | — | | | | | 4.02 | 0.26 | <1 | |

As seen in Table 2, very hydrophobic treatments can be achieved by combining polyvinylamine and PARC, either in two separate applications or by application of a mixture. Treatment with polyvinylamine alone, in trials J1, J2, N1, and N2 resulted in hydrophilic webs with fairly rapid intake times. Webs treated with polyvinylamine first and then PARC were less hydrophobic but generally showed intake times less than 60 seconds for both intake tests, with trials L1, L3, and L4 being exceptions. Trials L1 and L2 were similar except the curing step was skipped in trial L2. Without the curing step, trial L2 showed low intake times characteristic of a hydrophilic web, but trial L1 required over 30 seconds in the 25-μl Pipette Intake test and over 100 seconds for the Water Drop Intake test. Without wishing to be bound by theory, it is believed that the curing step increases hydrophobicity by driving reactions between the carboxyl groups of the PARC and the amine groups of the polyvinylamine to yield a reaction product having a hydrophobic backbone and a reduced number of hydrophilic functional groups.

In trials L3 and L4, the two solutions were sprayed on without an intermediate drying step (polyvinylamine first, then PARC). The samples of trial L3 were then cured, but those of trial L4 were not. Both exhibited high hydrophobicity. Without wishing to be bound by theory, it is believed that polyelectrolyte complexes between the PARC and the polyvinylamine form better when both are available to migrate and interact with each other in solution. By applying the polyvinylamine and then drying it before application of the PARC, as was the case in trials L1 and L2, the polyvinylamine probably had already formed hydrogen bonds with the cellulose and was not as free to recombine into polyelectrolyte complexes with the PARC as it is when present in solution form with PARC also present, as is the case then the two compounds are applied to the web without intermediate drying or as a mixture.

Based on the above results, webs treated with polyvinylamine and anionic compounds, according to the present invention, can have 25-μl Pipette Intake Times or Water Drop Intake Times greater than any of the following, in seconds: 5, 10, 15, 20, 30, 45, 60, 120, and 360. Webs can also be prepared by application of the polyvinylamine and another compound, such as an anionic polymer or surfactant, without an intermediate drying step, such that the polyvinylamine is in solution form when the second compound is added, or such that both the polyvinylamine and the second compound are simultaneously present in solution form in the presence of the web.

Tensile testing was conducted for a number of the trials listed in Table 2 above. Testing was done with a 3-inch gauge length and a 3-inch sample width, with a crosshead speed of 10 inches per minute. Raw data for the tested trials are reported in Table 3, with means and standard deviations.

TABLE 3

Dry and Wet Tensile Data for Several Trials of TABLE 2.

| Trial | Dry Tensile, g | Wet Tensile, g | % Wet/Dry | Mean | St. Dev |
|---|---|---|---|---|---|
| G1 | 4332 | 843 | 19 | 17 | 3.8 |
| " | 4209 | 776 | 18 | | |
| " | 4302 | 536 | 12 | | |
| H1 | 3927 | 881 | 22 | 19 | 2.7 |
| " | 3994 | 746 | 19 | | |
| " | 4236 | 727 | 17 | | |

TABLE 3-continued

Dry and Wet Tensile Data for Several Trials of TABLE 2.

| Trial | Dry Tensile, g | Wet Tensile, g | % Wet/Dry | Mean | St. Dev |
|---|---|---|---|---|---|
| H3 | 4717 | 1074 | 23 | 18 | 3.7 |
| " | 3435 | 544 | 16 | | |
| " | 3326 | 560 | 17 | | |
| " | 3328 | 603 | 18 | | |
| " | 3552 | 408 | 11 | | |
| I1 | 3898 | 757 | 19 | 22 | 2.6 |
| " | 3461 | 848 | 24 | | |
| " | 3520 | 798 | 23 | | |
| J1 | 2971 | 585 | 20 | 19 | 1.5 |
| " | 2893 | 586 | 20 | | |
| " | 3164 | 552 | 17 | | |
| K1 | 4222 | 790 | 19 | 19 | 0.8 |
| " | 4585 | 858 | 19 | | |
| " | 4662 | 939 | 20 | | |
| L1 | 4769 | 785 | 16 | 18 | 1.5 |
| " | 4728 | 820 | 17 | | |
| " | 4570 | 885 | 19 | | |
| L3 | 4372 | 733 | 17 | 17 | 1.4 |
| " | 4178 | 654 | 16 | | |
| " | 4111 | 755 | 18 | | |
| M1 | 4601 | 872 | 19 | 19 | 1.4 |
| " | 4814 | 958 | 20 | | |
| " | 4738 | 809 | 17 | | |
| N1 | 4883 | 967 | 20 | 21 | 0.7 |
| " | 4580 | 970 | 21 | | |
| " | 4446 | 916 | 21 | | |
| O1 | 4309 | 1078 | 25 | 19 | 5.1 |
| " | 4108 | 666 | 16 | | |
| " | 4014 | 649 | 16 | | |
| " | 3947 | 671 | 17 | | |
| " | 3818 | 610 | 16 | | |
| P1 | 3688 | 721 | 20 | 18 | 1.5 |
| " | 3454 | 623 | 18 | | |
| " | 3692 | 613 | 17 | | |
| Q1 | 3785 | 932 | 25 | 21 | 3.3 |
| " | 3206 | 588 | 18 | | |
| " | 3126 | 615 | 20 | | |
| R1 | 3636 | 141 | 4 | 4 | 0.3 |
| " | 3612 | 120 | 3 | | |
| " | 3573 | 122 | 3 | | |
| S1 | 3190 | 661 | 21 | 21 | — |

The tensile data in Table 3 show that combinations of polyvinylamine and PARC, as well as polyvinylamine and PARC alone, were effective in increasing the wet strength of the web. However, even webs that appeared relatively hydrophobic did not have extremely high wet strengths typical of what one might expect for a web that completely repelled water. Without wishing to be bound by theory, it may be that the mechanical agitation of the web that occurs as the web is dipped in water and then blotted allows some water to penetrate the web and wet fibers internally; plus the contacting the full width of the 3-inch wide cut sample during immersion in water allows for water penetration in the web through randomly scattered regions that may not have been uniformly treated with the applied chemicals, allowing water to enter the web and wick somewhat internally. Further, it is believed that the airbrush technique may still have resulted in regions with uneven mixtures of the two compounds, such that some portions of the web were relatively less hydrophobic than others, allowing tensile failure to occur in regions of relatively lower wet strength during testing.

In the trials of this Example where polyvinylamine and PARC were mixed prior to spraying on the web (trials O1, P1, and Q1), the samples in each trial were treated on two different days with the same mixed solutions. The first of the three samples in each of these trials was treated with the mixture on the same day the mixture was created (within 2 hours of preparation). The other two samples reported for each of these trials was treated with the mixtures 13 days later or with a new mixture comprising roughly 50% of the old mixture and a newly prepared mixture. The wet:dry ratios for the samples made with freshly prepared mixture were consistently higher (25%, 20%, and 25% for trials O1, P1, and Q1, respectively) than for the six samples prepared with "aged" mixtures, none of which exceeded 20%. For highest wet strengths or other targeted properties, it may be desirable to apply a mixture of polyvinylamine with a second compound shortly after the mixture is prepared (e.g., within 24 hours, specifically within 2 hours, more specifically within 20 minutes, and most specifically substantially immediately after preparation).

Example 4

Polyvinylamine interactions with polycarboxylic acids were explored as a tool for improving the affinity of acid dyes for cellulose fibers. The tissue for this Example is the untreated towel basesheet of Example 1. Three aqueous reaction solutions were prepared, with concentrations reported on a mass basis (mass of solids/total solution mass×100%):

Solution A: 4% Catiofast® PR 8106 solution.

Solution B1: 0.5% DP80 with 0.25% sodium hypophosphite catalyst (a PARC solution).

Solution B2: 1% DP80 with 0.5% sodium hypophosphite catalyst (a PARC solution).

Solution A was applied to untreated tissue at a wet pick-up level of 100% (1 gram of solution added per dry gram of tissue) by spray, and then dried at 80° C. The dried sheets were then treated either with Solution B1 or Solution B2 by spray with a wet pick-up of 100% and then dried at 80° C., followed by curing at 175° C. for 3 minutes in a convection oven. These treated sheets were then dyed by immersion for 5 minutes in a 1 wt % solution of C.I. Acid Blue 9 (a triphenylmethane acid dyestuff with a C.I. Constitution # of 42,090) at a pH of about 3.5, adjusted with sulfuric acid, and at a temperature of about 90° C. (85° C. to 95° C. is suitable). Additional sheets were treated in the same way but without the application of polyvinylamine. In other words, these sheets were treated only with Solution B1 or only with Solution B2 and then dried and cured, followed by dyeing. The same dyeing process was also applied to untreated tissue as well. The dyed sheets were removed from the dye solution and then immediately rinsed in water at room temperature water to remove unbound dye. Both the untreated sheet and the sheets treated with Solutions B1 or B2 only showed little affinity for the dye, which readily washed out of the webs, leaving only a barely visible purple tinge in otherwise white sheets. The webs treated with polyvinylamine (Solution A) and then PARC (either Solution B1 or B2) retained a rich purple color effectively, showing that the polyvinylamine treatment greatly increased the dyeability of the cellulose fibers with the acid dye, in addition to increasing the wet strength of the web.

Four samples of the same uncreped towel used above were tested again for dyeability. Solutions of either 0.5% Catiofast® 8106 polyvinylamine ("polyvinylamine") or 0.5% DP80 with 0.25% sodium hypophosphite catalyst (PARC) were used. Sections of tissue were first treated with polyvinylamine solution (except for Sample D, which received no polyvinylamine) by spraying with a Passche air brush on both sides of the tissue. The samples were dried for 20 minutes at 105° C. and then treated with PARC (except for Sample C, which received no PARC) and dried at 105° C. for 20 minutes. Samples A, C, and D were then cured for 3 minutes at 160° C. Treatments are listed in Table 4 below.

TABLE 4

Samples treated with polyvinylamine and/or PARC for use in dye tests.

| Sample | polyvinylamine | PARC | Cured |
|---|---|---|---|
| A | 350% | 100% | Yes |
| B | 175% | 175% | No |
| C | 350% | | Yes |
| D | 0% | 350% | Yes |

Each sample was then dyed by immersion in a 2% solution of FD&C Blue #1 dye at about 78° C. and with solution pH of 3.5. The sample was then placed in a 1000 ml beaker of tap water into which a continues stream of tap water flowed from a faucet to wash excess dye from the tissue for about 60 seconds. The dye was then placed in stagnant water for another period of time about 5 minutes in length, then its color was observed. Sample D, without polyvinylamine, showed a barely noticeable blue tinge, but generally appeared white. Samples A and C appeared equally dark, while Sample B was also strongly dyed but somewhat less intensely than Samples A or C.

The treatment of cellulose with both polyvinylamine and PARC should not only increase the affinity of the web for acid dyes, but for a wide variety of anionic compounds, including anionic silicones, lotions, emollients, anti-microbials, and the like.

Example 5

Handsheets were prepared using dialdehyde cellulose (DAC) pulp and a control pulp, Kimberly-Clark LL19 bleached kraft northern softwood. DAC pulp was also prepared from Kimberly-Clark LL19 northern softwood. 500 grams of LL-19 pulp with enough deionized water to make a 3% consistency slurry were soaked for 10 minutes then dispersed for 5 minutes in a Cowles Dissolver (Morehouse-COWLES, Fullerton, Calif.), Type 1VT. The slurry was dewatered using a Bock centrifuge, Model 24BC (Toledo, Ohio), operating for 2 minutes to yield a pulp consistency of about 60%. One half of the dewatered sample (about 250 grams of fiber, oven-dry basis) was used as a control, and the other half was used for chemical treatment. Sodium metaperiodate ($NaIO_4$) solution was prepared by dissolving 13.7 of $NaIO_4$ in 1.5 liters of deionized water. The pulp was then placed in a Quantum Mark IV High Intensity Mixer/Reactor (Akron, Ohio) and the sodium metaperiodate solution was poured over the pulp. The mixer was turned on every 30 seconds for a 5-second interval at 150 rpm to mix the pulp to allow the pulp to react with the sodium metaperiodate at 20° C. for one hour. The reacted pulp was then dewatered and washed with 8 liters of water two times. Fibers were kept moist and not allowed to dry. This treatment increased the aldehyde content of the cellulose from 0.5 meq/100 g to 30 meq/100 g, as measured by TAPPI Procedure T430 om-94, "Copper Number of Pulp, Paper, and Paperboard." The control pulp was also exposed to the same treatment but without the sodium metaperiodate.

Handsheets with a basis weight of 60 grams per square meter (gsm) made from the DAC pulp and the untreated pulp were treated with polyvinylamine polymers, either Catiofast® PR 8106 from BASF, which is a 90%-hydrolyzed polyvinylformamide, or Catiofast PR 8104, which is a 10%-hydrolyzed polyvinylformamide. Some of the handsheets were not treated with the polyvinylamine polymers. Treatment with polyvinylamine polymers was done to the pulp slurry before handsheet formation by adding 0.05% polyvinylamine polymer solution to the British disintegrator prior to the normal 5-minute disintegration period.

Soluble charge testing, as described above, was performed individually for the two handsheets treated with polyvinylamine polymers. Testing was done in the range of 5 to 8 pH to insure that the chemicals would have a cationic charge. The pH did not appear to have a significant effect on the charge. For soluble charge testing two samples per code were tested and the standard deviation was less than 5%. Results are shown in Table 5. The soluble charge of fibers treated with Catiofast® PR 8106 was two to three times higher than Catiofast® PR 8104. For a 0.002% solution of Catiofast® PR 8106 the soluble charge was about 150 meq/L and for Catiofast® PR 8104 it was about 60 meq/L; substantially independent of pH in the range tested. Typical soluble charge values for the control pulp range from −10 to −2 meq/L. At 1% addition of Catiofast® PR 8104, both the soluble charge for the control pulp and DAC pulp were slightly cationic; therefore, it is believed that the chemical was retained on the pulp instead of remaining in the water.

TABLE 5

Soluble Charges for polyvinylamine Treated DAC and Control Pulps

| Pulp | Chemical Addition (% odg) | Soluble Charge (meq/L) |
|---|---|---|
| Control | 1% 8104 | 27.3 |
| DAC | 1% 8104 | 27.7 |
| Control | 1% 8106 | 164.7 |
| DAC | 1% 8106 | 152.9 |
| DAC | 3% 8106 | 311.8 |

The handsheets were also tested for tensile strength, with results shown in FIG. 1. The DAC pulp had reduced tensile strength relative to the LL19 pulp, apparently due to the known degradation of cellulose that occurs when it is oxidized to its dialdehyde form. The control pulp without added polyvinylamine polymer had a tensile index of about 28 Nm/g, whereas a typical unprocessed LL19 sample normally yields a tensile index about 20 Nm/g; the increased strength of the control pulp is believed to be attributable to the mechanical processing in the Quantum mixer, adding a degree of refining to the fibers.

For both the DAC pulp and the control pulp, application of Catiofast® PR 8106 led to higher strength gains than application of Catiofast® PR 8104. The higher number of amino groups on the Catiofast® PR 8106 is believed to allow increased hydrogen bonding with cellulose for increased strength. Much higher gains in strength were seen with the DAC pulp. For a 3% add-on level of Catiofast® PR 8106, strength increased by 67% with the DAC pulp as compared to an 18% increase with the control pulp.

Figure 2:
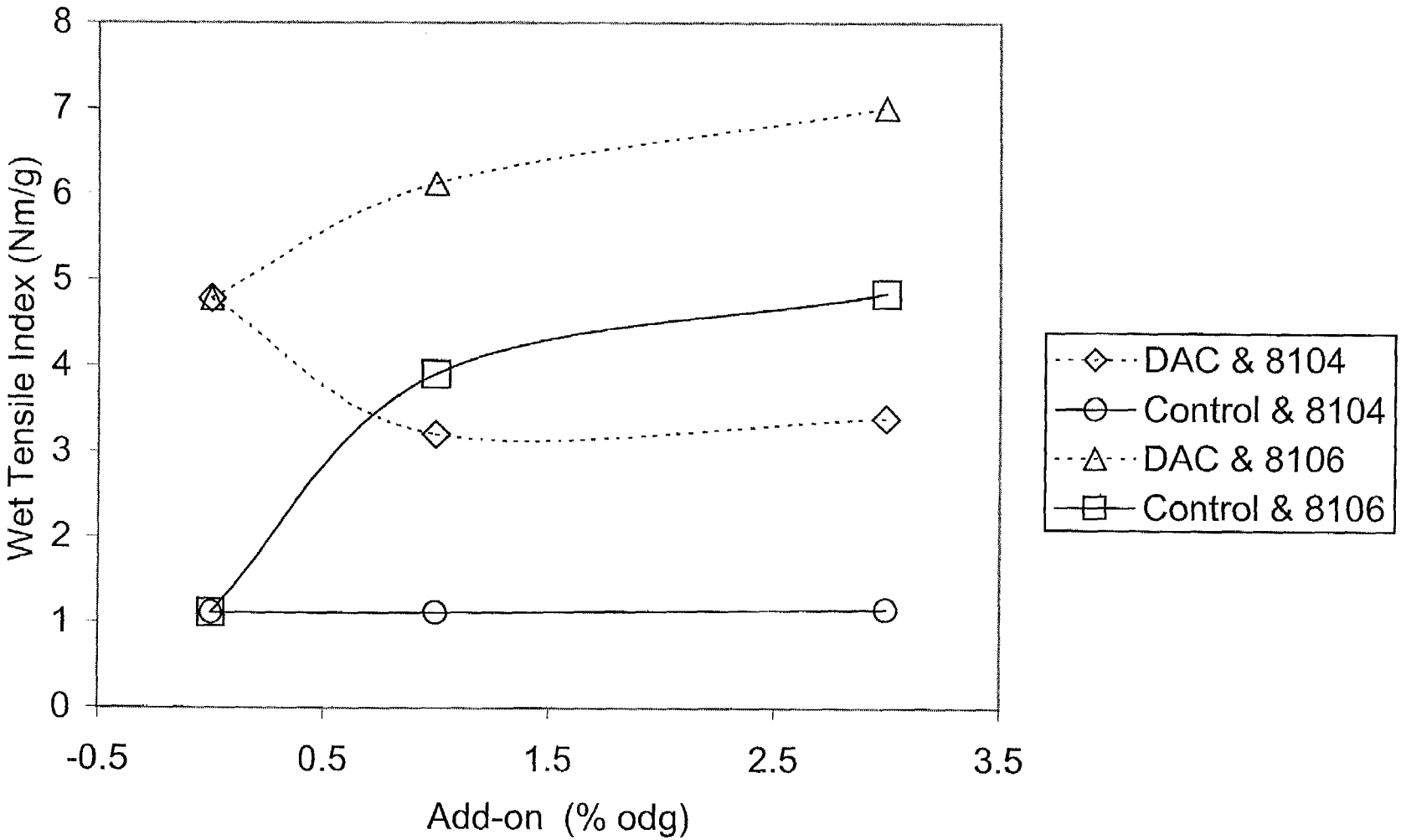
Figure 3:
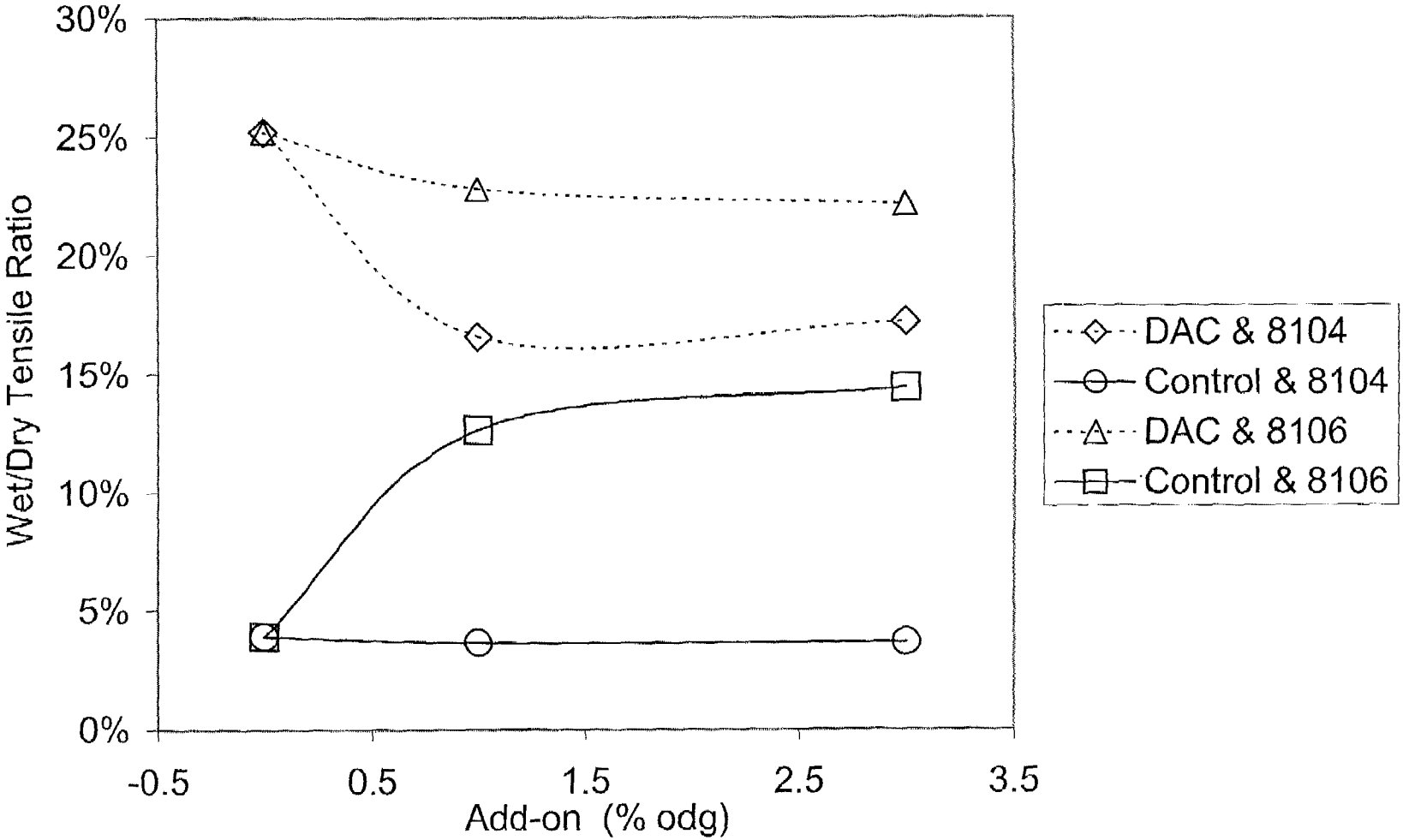

Wet strength for the handsheets is shown in FIGS. 2 and 3, which show the wet tensile index and the wet:dry tensile ratio, respectively, for both DAC pulp and the contol pulp as a function of polyvinylamine add-on. While the DAC pulp had lower dry tensile strength than the control pulp, its wet tensile strength was significantly higher than for the control pulp. It is speculated that crosslinking of involving aldehyde groups occurs during drying which increases the wet strength of the DAC. The wet strength development with addition of Catiofast® PR 8106 was similar for the DAC and control pulps (FIG. 2).

Example 6

Handsheets of LL19 pulp (pulp which was not processed in a Quantum mixer, as was the case for the control pulp of Example 5) were prepared and treated with combinations of polyvinylamine, a commercial wet strength additive (Kymene 55LX from Hercules Inc., Wilmington, Del.), and ProSoft debonder (ProSoft TQ1003 softener, manufactured by Hercules Inc., Wilmington, Del.). ProSoft is an imidazoline debonder (more specifically, an oleylimidazolinium debonder) which inhibits hydrogen bonding, resulting in a weaker sheet. Unless otherwise specified, chemicals were added to the slurry prior to disintegration.

Treated sheets were tested with 5 samples per condition, with results shown in Table 6. The standard deviation of the strength results was less than 10% for each of the sets of 5 samples. Interestingly, adding Kymene and polyvinylamine did not lead to significant strength gains relative to the same amount of Kymene alone for the conditions tested. Based on the soluble charge data for the 1% Kymene and 1% Kymene/1% polyvinylamine samples, the lack of strength development is not believed to be a result of poor retention. The soluble charge for 1% kymene and 1% Catiofast® PR 8104 (from Table 1) were about 50 meq/L and about 30 meq/L, respectively. Comparing these with the 1% Kymene/1% polyvinylamine soluble charge of about 80 meq/L, it seems plausible that both chemicals were retained to a similar extent.

Interestingly, in the case of ProSoft addition, it appears that the addition polyvinylamine to a web comprising debonder can result in a significant increase in wet:dry tensile ratio (from 9.7% to 14.1%) for the amine-rich Catiofast® PR 8106.

TABLE 6

Strength Development of LL19 Treated with Kymene, ProSoft, and polyvinylamines

| Pulp | Chemical | Conc. (%) | Dry Tensile (Nm/g) | Wet Tensile (Nm/g) | Wet/Dry ( ) | Soluble Charge (meq/L) |
|---|---|---|---|---|---|---|
| Control | no | 0 | 16.88 | 1.02 | 6.1% | −10 |
| Control | Kymene/8104* | 1 & 1 | 18.94 | 4.74 | 25.0% | 83 |
| Control | Kymene/8106* | 1 & 1 | 16.74 | 3.05 | 18.2% | 238 |
| Control | Kymene* | 1 | 18.46 | 4.56 | 24.7% | 54 |
| Control | ProSoft | 0.5 | 7.83 | 0.76 | 9.7% | −1 |
| Control | ProSoft/8104 | 0.5 & 1 | 11.61 | 0.71 | 6.1% | 57 |
| Control | ProSoft/8106 | 0.5 & 1 | 13.94 | 1.97 | 14.1% | 160 |

*Samples cured for 6 minutes at 105° C.

Example 7

Figure 4:
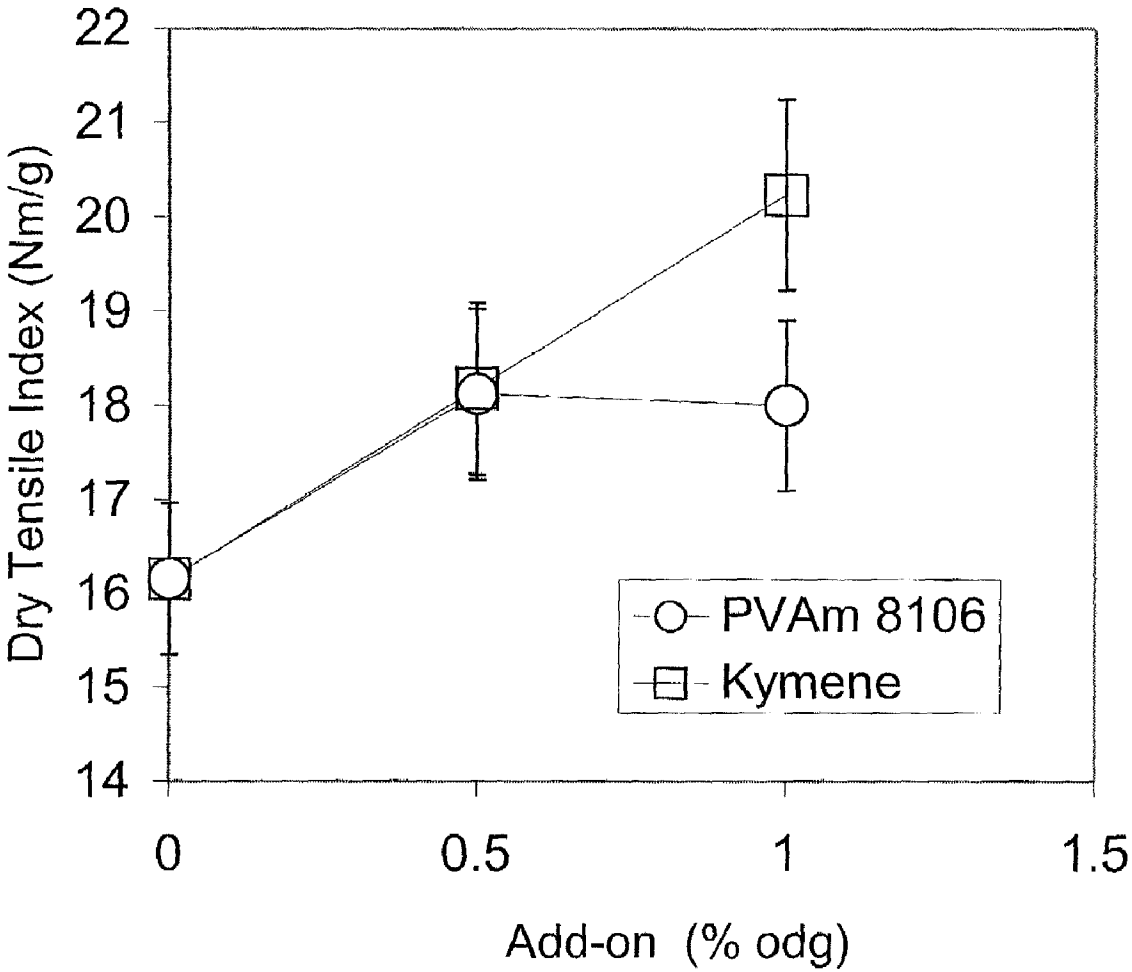
Figure 5:
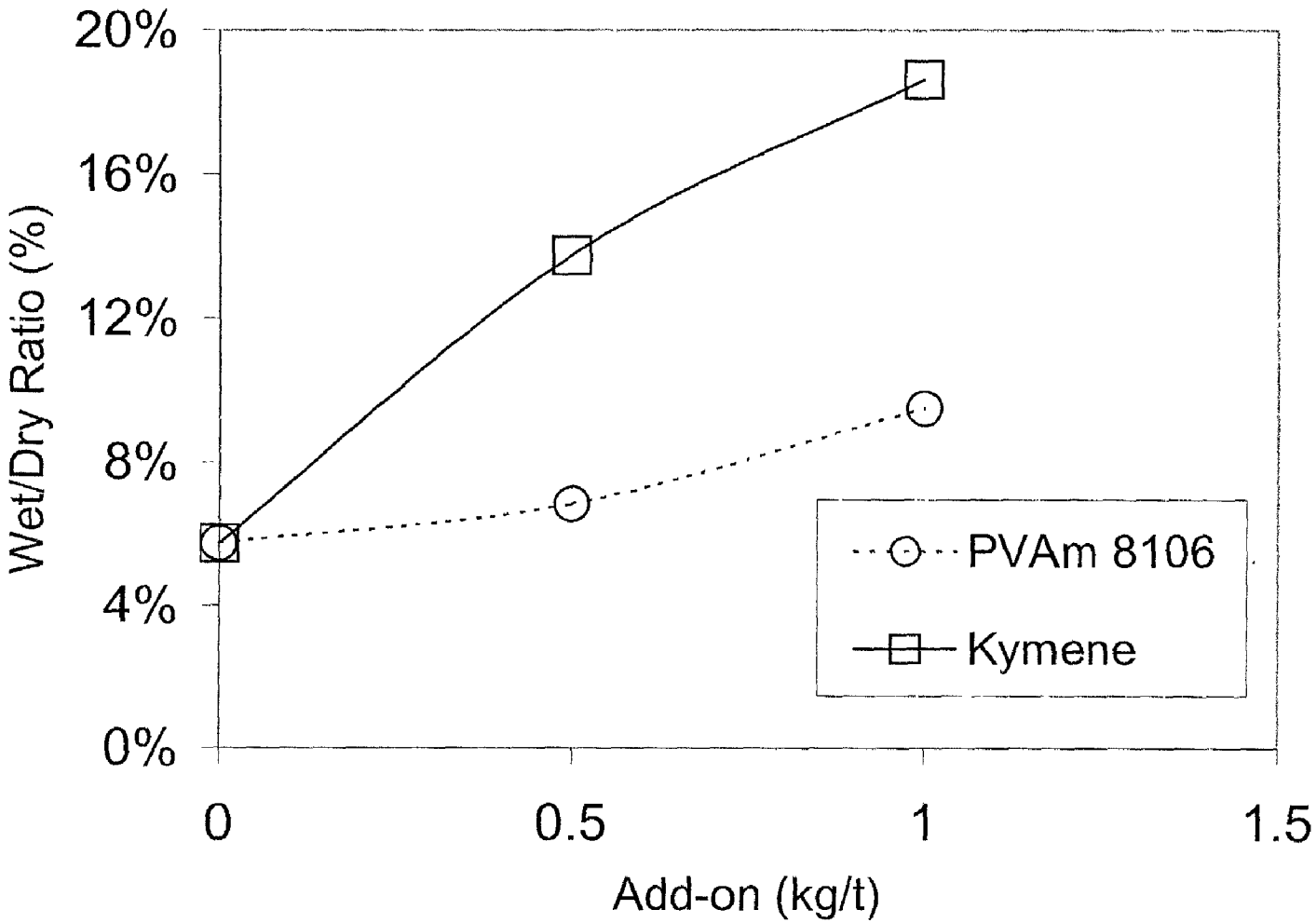

Handsheets were treated with polyvinylamines and Kymene at lower levels than in the previous Examples. Two Kymene-polyvinylamine systems were evaluated to determine if crosslinking between the two polymers readily occurred. In FIG. 4, the dry tensile strength of LL19 handsheets is shown as a function of add-on levels for Catiofast® PR 8106 and Kymene. Error bars show the range of the results, which 5 samples being tested per reported mean. Kymene and polyvinylamine develop dry strength similarly at the add-on level of 0.5 kg per metric tonne (kg/t), but Kymene gives higher wet strength at 1 kg/t than the polyvinylamine. FIG. 5 presents the wet/dry for the two chemicals.

FIG. 5 shows the wet:dry tensile strength ratios as a function of chemical add-on. Again, Kymene leads to greater levels of wet strength increase than Catiofast® PR 8106.

Example 8

Figure 6:
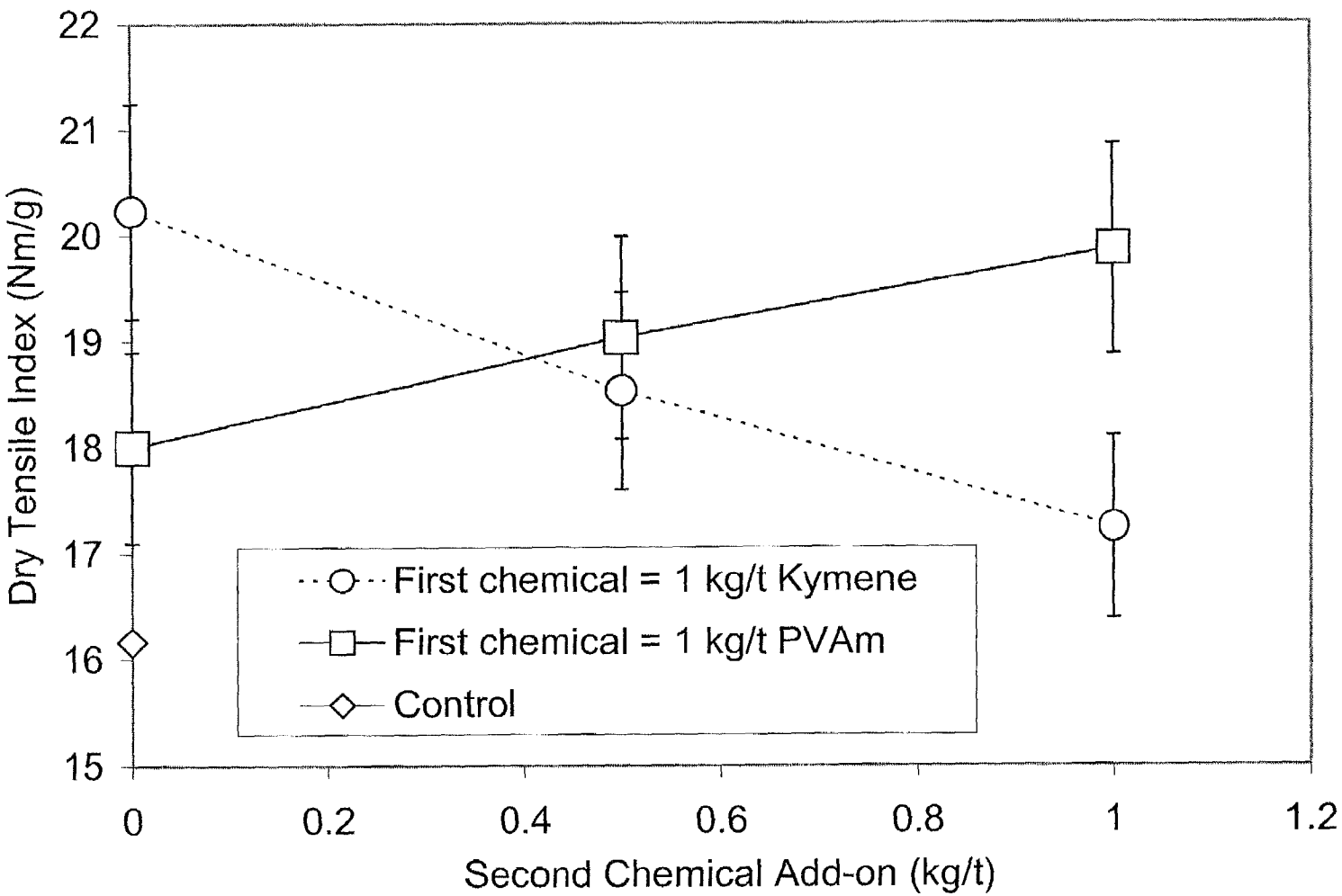
Figure 7:
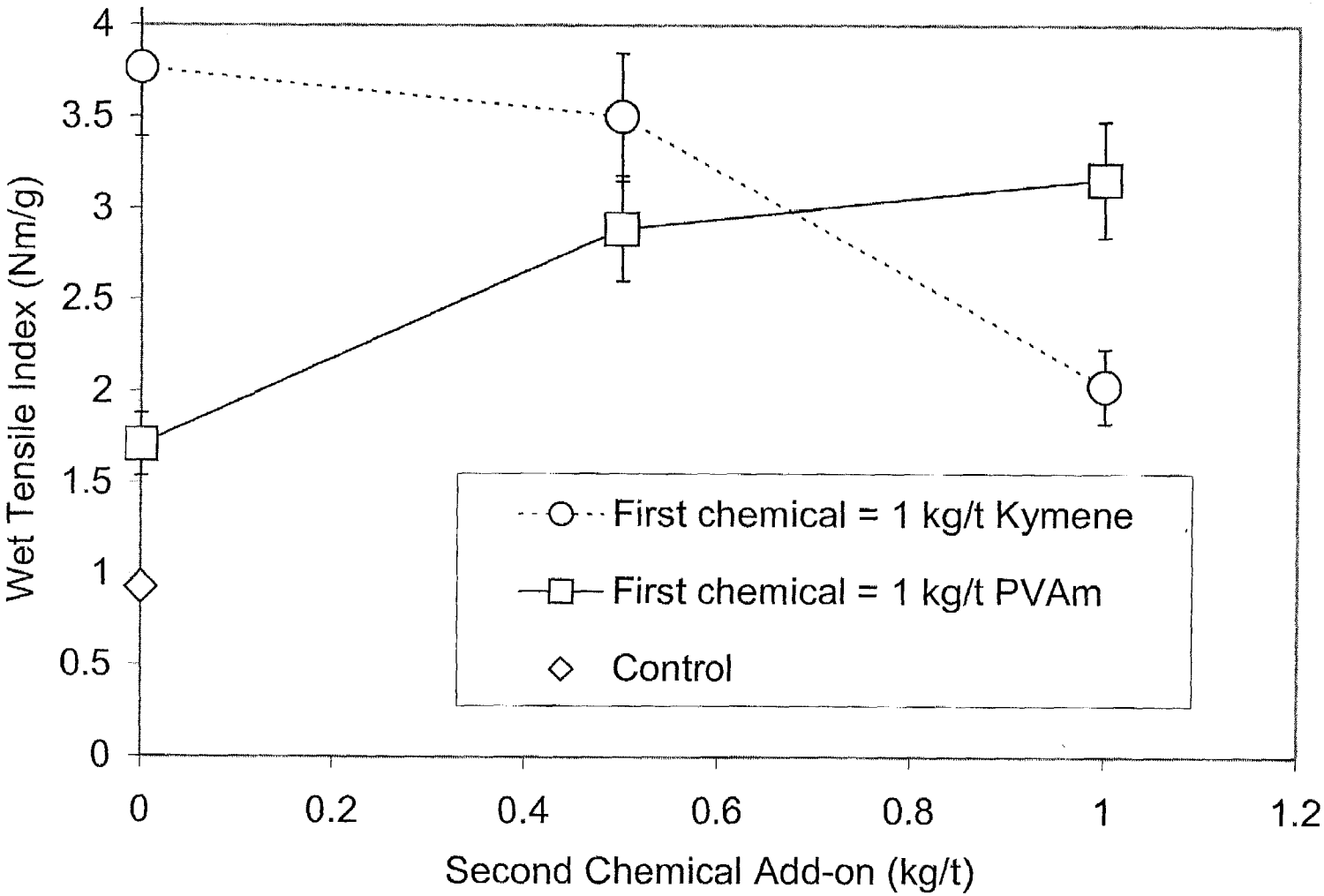

The impact on strength development as a result of order of chemical addition and combination chemistries was investigated. For the dual chemistry systems, the first chemical was added to the British pulp disintegrator prior to disintegration of the soaked LL19 pulp. Disintegration continued for five minutes. The add-on level of the first chemical was held constant (1 kg/material of fiber). The second chemical was added to the British pulp disintegrator and disintegrated for another five minutes. In FIGS. 6 to 7 below, the second chemical addition level is presented on the x-axis of the figures and varies from 0 to 1 kg/t.

The two curves in FIG. 6 were constructed by changing the order of addition for Kymene and polyvinylamine (Catiofast® PR 8106). The curve with the positive slope (1 kg/t polyvinylamine added first and held constant) shows an increase in strength with increasing amounts of Kymene added to fibers already treated with Catiofast® PR 8106, though the end-point strength with 1 kg/t each of Kymene and polyvinylamine was surprisingly low, being slightly less than the strength obtained with 1 kg/t of Kymene alone, indicating that the polyvinylamine may interfere with strength development from Kymene.

The curve with the negative slope was constructed by first treating the pulp with 1 kg/t Kymene followed by varying addition (0, 0.5, and 1.0 kg/t) of polyvinylamine (Catiofast® PR 8106). Surprisingly, the dry strength decreased as the polyvinylamine addition increased, showing an interference between the two compounds in terms of strength development. The data points at the far right side of FIG. 6 have the same quantities of added chemicals, 1 kg/t each of polyvinylamine and Kymene, yet show significantly different tensile strengths, apparently due to the order of addition. Addition of polyvinylamine to fibers first, followed by addition of Kymene, results in significantly lower strength than a similar composition prepared with the reverse order of addition of the two additives. Thus, the order of addition of two or more compounds, including polyvinylamine, can be adjusted to obtain different mechanical and chemical properties of the web for a given quantity of added chemicals.

FIG. 7 shows the wet strength data for the samples of FIG. 6. The effect of order of addition on wet strength again can be determined from the results shown therein. Here 1 kg/t polyvinylamine addition yielded a wet strength index of 1.24 Nm/g, not significantly different from that of the untreated LL19, 0.93 Nm/g. The addition of Kymene to the polyvinylamine treated pulp increased the wet strength to 3.16 Nm/g, generating a wet:dry ratio of 16%. 1 kg/t of Kymene alone yielded a wet strength index of 1.71 Nm/g and wet:dry ratio of about 19%. For the case of initial Kymene addition followed by addition of varying amounts of polyvinylamine, the decrease in wet strength with polyvinylamine add-on resembles the results shown in FIG. 6 for dry strength. Addition of the polyvinylamine reduces wet strength development and the wet:dry tensile ratio decreases from 19% for sheets with 1 kg/t Kymene alone to 15% for sheets with 1 kg/t Kymene plus 1 kg/t polyvinylamine.

Example 9

ProSoft, an imidazoline debonder (ProSoft TQ1003 softener, manufactured by Hercules Inc., Wilmington, Del.), was tested in combination with polyvinylamine to determine if further control over dry and wet strength development could be obtained.

Figure 8:
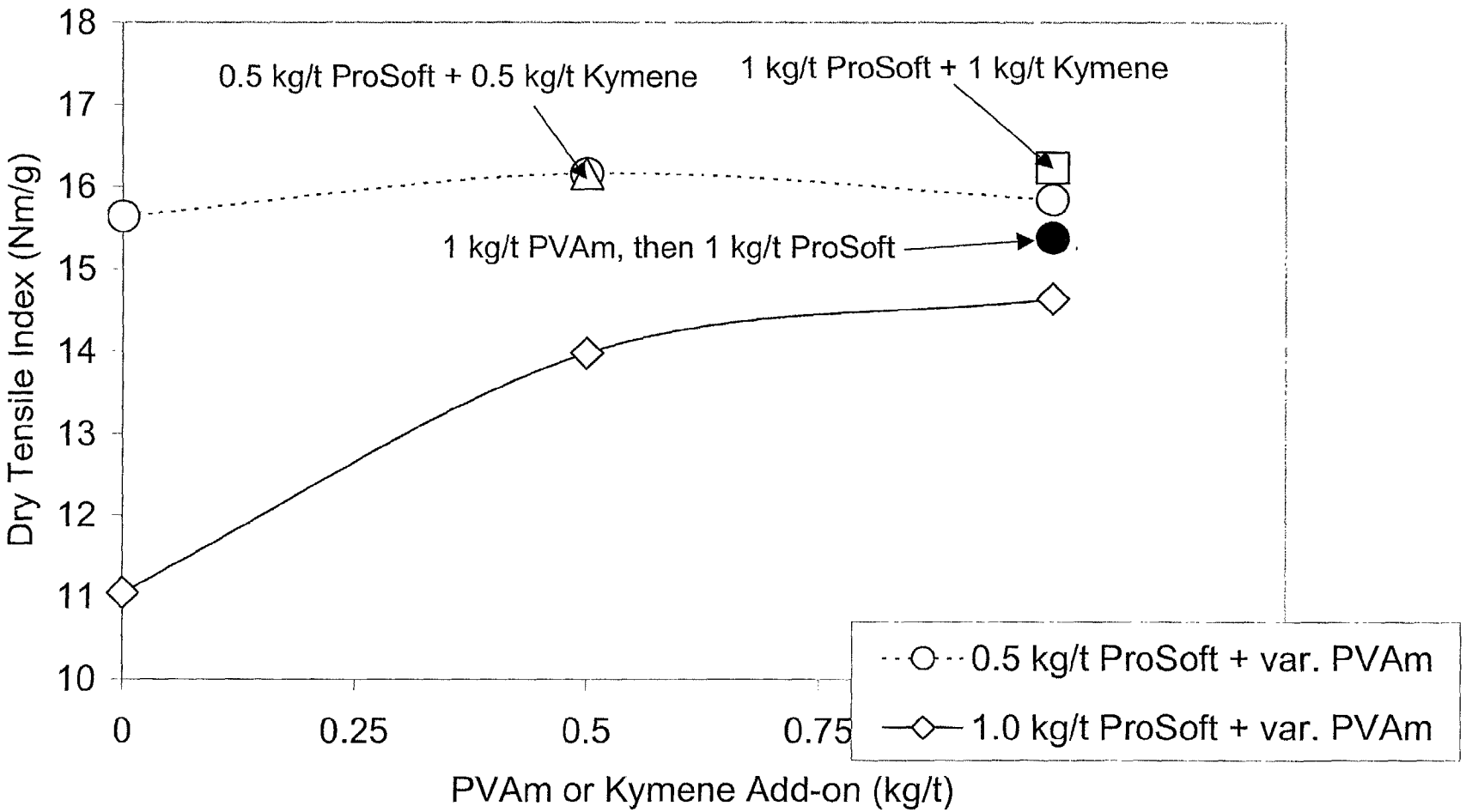
Figure 9:
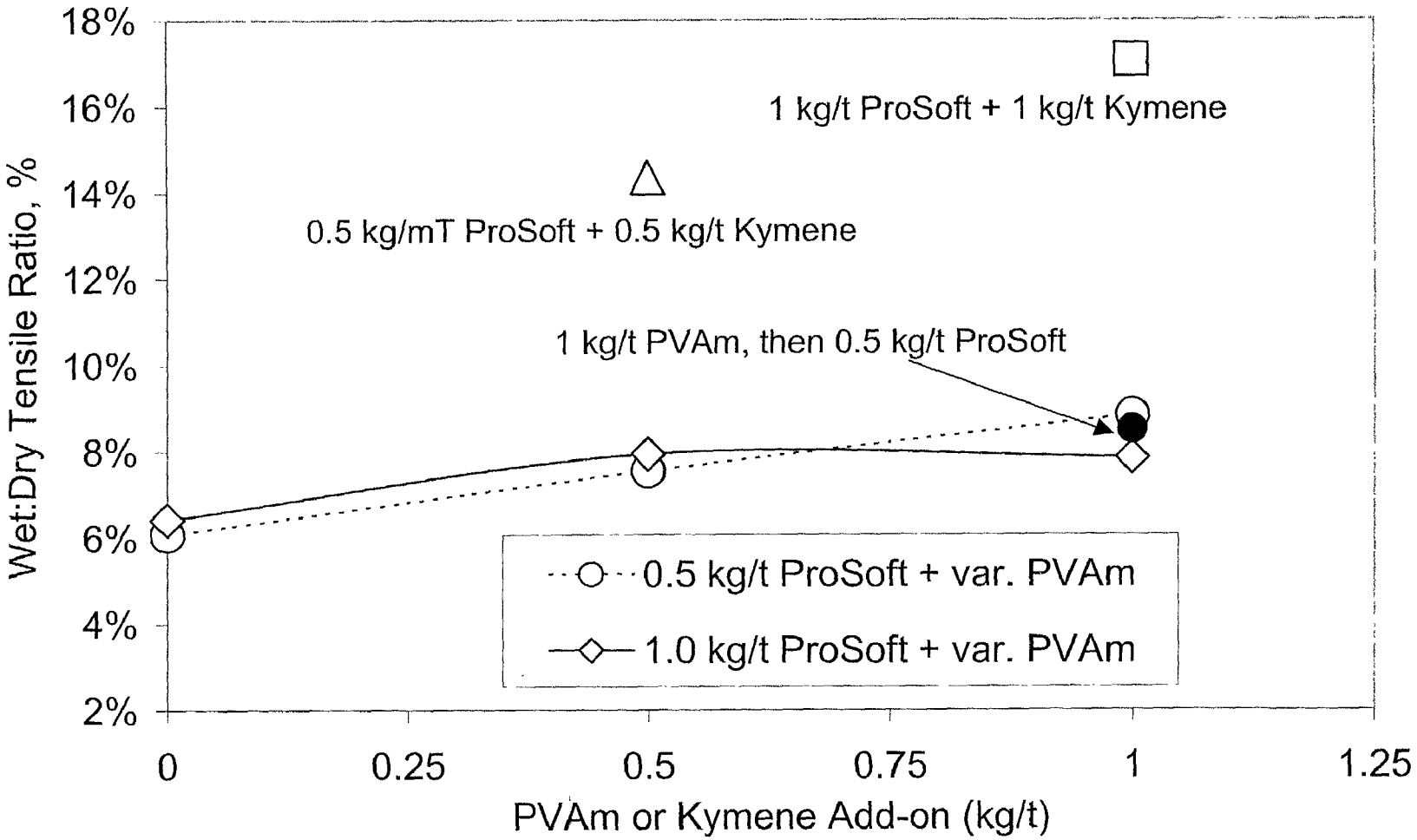

Pulp samples were treated with either 0.5 kg/t or 1.0 kg/t ProSoft, followed by various addition levels of polyvinylamine. The intent was to debond the sheet by reducing the hydrogen bonding between fibers, then rebuild strength with either polyvinylamine or Kymene. The effect of addition order was examined. Results are shown in FIGS. 8 and 9, which show dry strength results and wet strength results, respectively. The three labeled points on the upper portions of FIGS. 8 and 9 show additional experiments not on the labeled curves. For these points, the compound listed first was added first, followed by addition of the second-listed compound.

No significant debonding occurred at 0.5 kg/t ProSoft addition (15.64 NM/g treated verses 16.16 Nm/g in the control). Even though no significant decrease in dry strength was observed at 0.5 kg/t ProSoft, the subsequent polyvinylamine treatment did not significantly increase strength. 1 kg/t ProSoft addition resulted in a dry strength reduction from 16.16 Nm/g to about 11 Nm/g. At a constant level of 1.0 kg/t of ProSoft, the dry strength was recovered as the addition of polyvinylamine was increased. It appears that polyvinylamine can be added to debonded sheets or fibers to regain significant levels of tensile strength.

Combining ProSoft and polyvinylamine treatments did not significantly enhance wet:dry strength ratio, as shown in FIG. 9. The polyvinylamine addition to the debonded pulp resulted in both wet and dry strength increases; the flat wet/dry strength curve signifies that the two strength measures increased at roughly the same rate. A similar wet:dry strength ratio was reached with 1 kg/t polyvinylamine as with 1 kg/t ProSoft plus1 kg/t polyvinylamine. The ProSoft/Kymene combinations provided a higher wet:dry strength ratio than the corresponding ProSoft/polyvinylamine combinations.

Example 10

Figure 10:
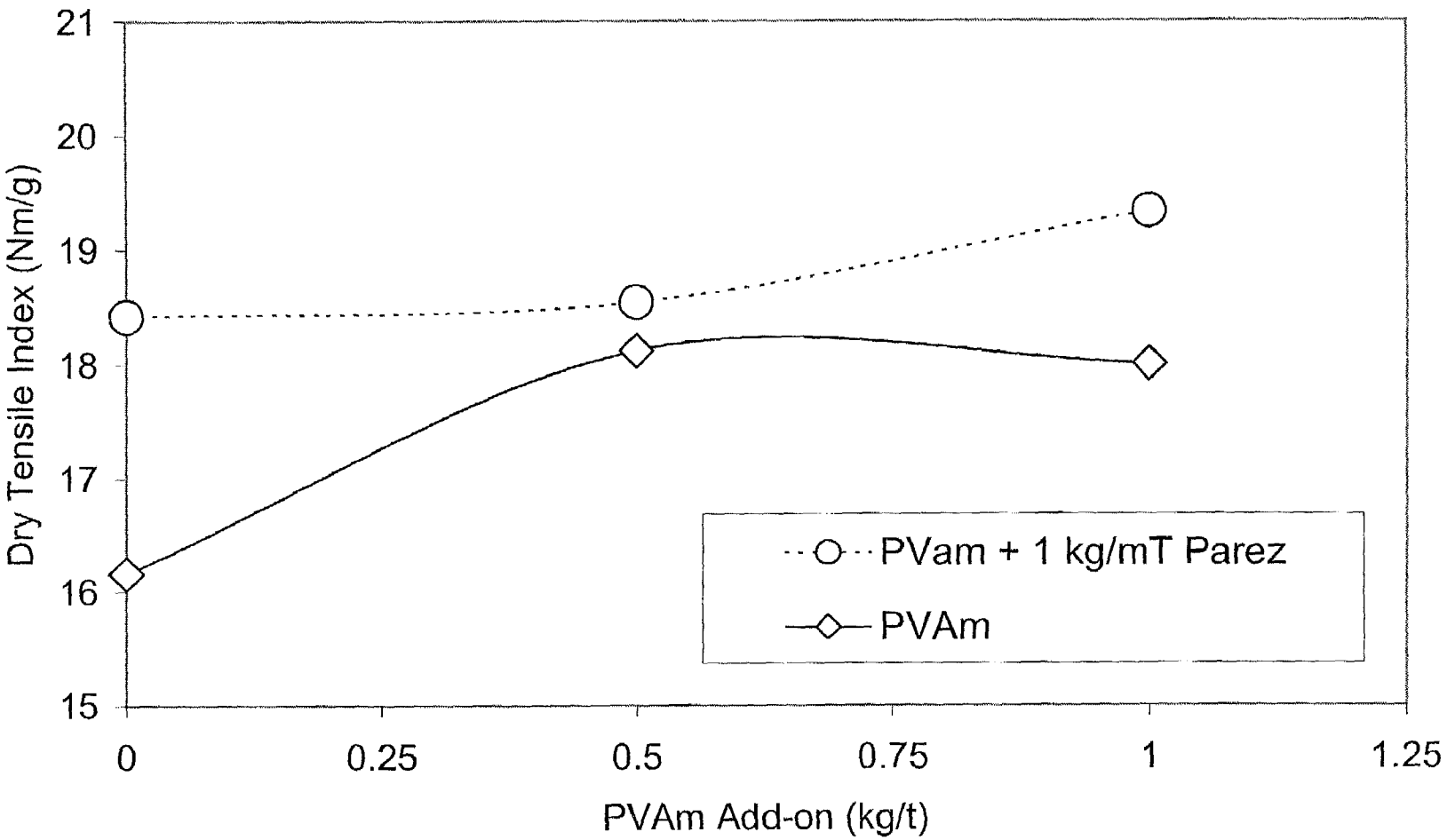

Handsheets were prepared from LL19 pulp and treated with Catiofast® PR 8106 alone or both Parez 631 NC Resin (Cytec Industries), a cationic glyoxylated polyacrylamide, and Catiofast® PR 8106. For the Parez-treated cases, the sheets were first treated with 1 kg/t Parez, dewatered in a Buechner funnel on a Whatman No. 4 filter paper to about 50% consistency to remove the majority of the free chemical, and finally treated with various add-on levels of the polyvinylamine. Results are shown in FIG. 10. Adding Parez increases the dry strength beyond what is achieved with Catiofast® PR 8106 alone.

Example 11

Handsheets with a target basis weight of 63.3 gsm were prepared according to the alternate handsheet procedure given above from 65% bleached kraft eucalyptus and 35% Kimberly-Clark LL-19 northern softwood pulp. Pulp was soaked 5 minutes then disintegrated for 5 minutes. After disintegration the 50 grams of pulp was diluted to 8 liters (0.625% consistency) before chemicals were added. Chemicals added included a 1% aqueous solution of Parez 631NC (a glyoxylated polyacrylamide) manufactured by Cytec Industries and a 1% aqueous solution of Catiofast® PR 8106 polyvinylamine. Polyvinylamine add-on levels relative to dry fiber content expressed in weight percents were 0, 0.25, 0.5 and 1. Parez levels expressed in weight percents were 0, 0.25, 0.5 and 1. With the exception of one code or test, the polyvinylamine was added first and stirred for 10 minutes. The Parez solution was added next and stirred for 2 minutes before starting handsheet preparation. A standard mechanical mixer was used at moderate shear. For the one code where Parez was added first, the furnish was stirred 10 minutes after Parez addition then Catiofast added and solution stirred for 2 minutes prior to handsheet preparation.

After handsheets were formed, the sheets were pressed and dried in the normal manner with final drying at 105° C.

Handsheets were then subjected to tensile testing, with results given in Table 7 below. Code 13 is listed last, out of place in the sequence, because it is the sole case where Parez was added first. polyvinylamine ("PV") and Parez are given in units of percent add-on relative to dry fiber mass. "TI" is the tensile index in Nm/g. Wet/dry is the ratio of wet tensile index to dry tensile index times 100. "Dry TI Gain" is the percentage increase in dry tensile strength relative to the control, Code 1.

A surprisingly large gain in strength can be obtained when the temporary wet strength agent, a polymer comprising aldehyde groups, is added first to cellulose fibers, followed by addition of polyvinylamine. In light of Example 10, where more modest strength gains were observed, the benefit may be enhanced when both compounds are added to the cellulose fibers before the fibers have been formed in a web or before the consistency of the fibers (in slurry or web form) increases above a value such as about any of the following: 5%, 10%, 20%, 30%, 40%, and 50%. Without wishing to be bound by theory, it is believed that a low consistency (high water content) can facilitate the interaction between the two compounds to provide good gains in at least some material properties of the resulting web.

Example 12

Handsheets were prepared as in Example 11, but with addition of Parez first followed by polyvinylamine for codes 17 through 26. In Code 27, polyvinylamine was added first. Results are shown in Table 8. Code 27 is a repeat of Code 11 in Example 11, and Code 22 is a repeat of Code 13 in Example 11. The good reproducibility in the results confirms the observation that treatment of the fibers with Parez first followed by addition of polyvinylamine gives significantly better results than treatment in the reverse order.

TABLE 7

Tensile data for handsheets treated with polyvinylamine and/or Parez (set one).

| Code | PV | Parez | BW | Dry peak load, g | Dry TEA | Dry Max Slope | Dry TI | Wet TI | Wet/dry, % | Dry TI Gain, % |
|---|---|---|---|---|---|---|---|---|---|---|
| 1 | 0 | 0 | 64.2 | 2772 | 8.63 | 483 | 16.67 | 1.06 | 6.4 | 0.0 |
| 2 | 0.25 | 0 | 63.4 | 3041 | 9.47 | 494 | 18.52 | 2.53 | 13.7 | 11.1 |
| 3 | 0.5 | 0 | 65.2 | 3496 | 10.76 | 542 | 20.72 | 3.79 | 18.3 | 24.3 |
| 4 | 1 | 0 | 63.6 | 3601 | 12.37 | 553 | 21.86 | 4.26 | 19.5 | 31.1 |
| 5 | 0 | 0.25 | 64.6 | 3636 | 13.89 | 544 | 21.75 | 2.95 | 13.6 | 30.5 |
| 6 | 0.25 | 0.25 | 64.2 | 3895 | 16.99 | 545 | 23.42 | 3.62 | 15.5 | 40.5 |
| 7 | 0.5 | 0.25 | 64.7 | 4297 | 19.34 | 564 | 25.64 | 4.16 | 16.2 | 53.8 |
| 8 | 1 | 0.25 | 64.7 | 4572 | 21.61 | 565 | 27.28 | 5.35 | 19.6 | 63.6 |
| 9 | 0 | 0.5 | 64.9 | 4271 | 20.35 | 544 | 25.42 | 5.08 | 20.0 | 52.5 |
| 10 | 0.25 | 0.5 | 63.7 | 4295 | 19.24 | 573 | 26.05 | 3.84 | 14.7 | 56.3 |
| 11 | 0.5 | 0.5 | 64.7 | 4663 | 22.63 | 620 | 27.84 | 4.57 | 16.4 | 67.0 |
| 12 | 1 | 0.5 | 65 | 5471 | 29.9 | 630 | 32.48 | 5.78 | 17.8 | 94.8 |
| 14 | 0 | 1 | 63.8 | 4894 | 29.188 | 542 | 29.63 | 6.23 | 21.0 | 77.7 |
| 15 | 0.25 | 1 | 63.8 | 4894 | 25.28 | 573 | 29.6 | 5.55 | 18.8 | 77.6 |
| 16 | 0.5 | 1 | 65.9 | 4880 | 24.32 | 627 | 28.58 | 5.41 | 18.9 | 71.4 |
| 13 | 0.5 | 0.5 | 63.9 | 5943 | 33.95 | 664 | 35.92 | 7.17 | 20.0 | 115.5 |

Several findings can be drawn from this data. For cases where Catiofast was added first, a simple additive effect is seen on dry strength for Parez levels up to 0.5%. However, a surprising synergistic effect is observed when the Parez is added first. In the case of 0.5% polyvinylamine plus 0.5% Parez (Code 11), where the polyvinylamine was added first, a dry tensile increase of 67% was noted relative to an untreated sheet. The 67% increase approximates the sum of the dry strength gains for 0.5% Parez alone (52% for Code 9) and 0.5% polyvinylamine alone (24% for Code 3). However, when 0.5% Parez was added first followed by 0.5% polyvinylamine in Code 13, a 115% increase in dry tensile strength was noted. This is almost double the increase in tensile from Code 11 when the opposite order of addition was used. Thus, the order of addition can play an important role and can be tailored for the desired material properties.

An unusually high level of dry strength gain is shown for some of the codes, such as Codes 25 and 26, where the dry strength of the treated samples is nearly triple that of the control Code 17 (i.e., nearly a 200% increase in dry tensile index). Based on the data in Table 7 for Code 3, 0.5% polyvinylamine alone is expected to increase the dry tensile index by 24.3%. Based on Code 14 in Table 7,1% Parez alone is expected to increase the dry tensile index by 77.7%. If the two compounds together increased dry strength according to a simple additive model, the expected gain for Code 25 in Table 8, with 0.5% polyvinylamine and 1% Parez, would be 24.3% +77.7%=102%. Instead, a much higher gain of 177% is observed. Similarly, for Code 26, the expected additive gain in dry tensile index would be 108.8%, but nearly twice that level is observed, namely, 196.6%. The apparent synergy of the two compounds results in a gain of (196.6–108.8)/108.8×100%=80.7% relative to the expected dry tensile index without synergy, or a Dry Tensile Synergy Factor of 80.7%.

In general, it is believed that treatment of a fibrous slurry with an aldehyde-containing additive, followed by treatment with a polyvinylamine compound and formation of a paper web, can result in dry tensile index gains substantially greater than one would predict based on a linear additive model. The Dry Tensile Synergy Factor can any of the following: about 20% or greater, 40% or greater, 50% or greater, 60% or greater, or 80% or greater.

Similar results are obtained in the analysis of the wet tensile index in Tables 7 and 8, where significant synergy is evident between polyvinylamine and Parez, especially when the Parez is added first. Unusually high wet tensile index values are seen in Table 8. Following the concept of the Dry Tensile Synergy Factor, a Wet Tensile Synergy Factor can also be calculated based on wet tensile index values. The Wet Tensile Synergy Factor can any of the following: about 20% or greater, 40% or greater, 50% or greater, 60% or greater, 80% or greater, or 100% or greater. The same set of values can also apply to a Dry TEA Synergy Factor, calculated based on dry TEA values.

TABLE 8

Tensile data for handsheets treated with polyvinylamine and/or Parez (set two).

| Code | PV | Parez | BW | Dry peak load, g | Dry TEA | Dry Max Slope | Dry TI | Wet TI | Wet/dry, % | Dry TI Gain, % |
|---|---|---|---|---|---|---|---|---|---|---|
| 17 | 0 | 0 | 65.6 | 3085 | 11.2 | 489 | 18.16 | 1.12 | 6.2 | 0.0 |
| 18 | 0.25 | 0.25 | 64.6 | 5411 | 32.7 | 602 | 32.34 | 5.98 | 18.5 | 78.1 |
| 19 | 0.5 | 0.25 | 63.9 | 5852 | 39.9 | 599 | 35.34 | 7.34 | 20.8 | 94.6 |
| 20 | 1 | 0.25 | 64.3 | 6400 | 50.0 | 621 | 38.41 | 8.35 | 21.7 | 111.5 |
| 21 | 0.25 | 0.5 | 64.6 | 6113 | 45.5 | 605 | 36.57 | 7.99 | 21.8 | 101.4 |
| 22 | 0.5 | 0.5 | 65.7 | 7017 | 63.0 | 642 | 41.27 | 9.59 | 23.2 | 127.3 |
| 23 | 1 | 0.5 | 63.7 | 6557 | 56.0 | 611 | 39.73 | 8.51 | 21.4 | 118.8 |
| 24 | 0.25 | 1 | 63.9 | 5657 | 40.0 | 601 | 34.16 | 5.84 | 17.1 | 88.1 |
| 25 | 0.5 | 1 | 64.0 | 8353 | 96.8 | 598 | 50.38 | 10.79 | 21.4 | 177.4 |
| 26 | 1 | 1 | 64.8 | 9044 | 105.6 | 629 | 53.87 | 12.41 | 23.0 | 196.6 |
| 27 | 0.5 | 0.5 | 63.7 | 5530 | 37.0 | 620 | 33.54 | 6.42 | 19.1 | 84.7 |

Figure 11:
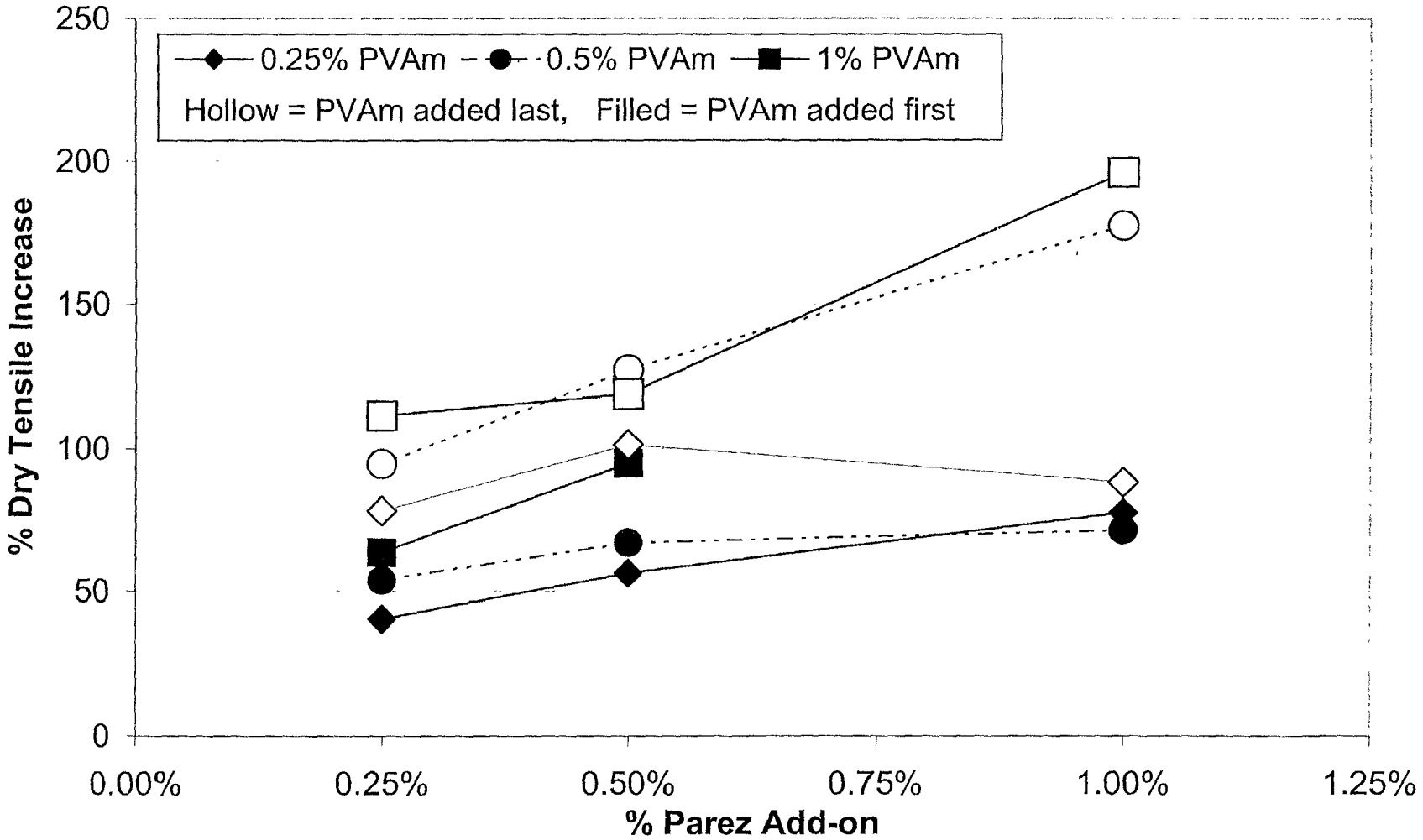

FIG. 11 compares several codes from Tables 7 and 8. Diamonds, circles, and squares represent polyvinylamine (polyvinylamine) add-on levels of 0.25%, 0.50%, and 1%, respectively. Filled (black) symbols indicate that polyvinylamine was added before the Parez, while hollow symbols indicate polyvinylamine was added after the Parez. Significant effects of the order of addition are evident. The effect of order of addition is especially great at the highest Parez level of 1% for the two higher polyvinylamine levels.

Example 13

A 1% aqueous solution of poly(methylvinylether-alt-maleic acid),from Aldrich Chemicals, having a molecular weight of 1.98 million, was mixed with a 1% solution of the Catiofast 8106 polyvinyl amine. A precipitate formed quickly and did not dissolve in water. This same effect was noted with SSB-6, a salt-sensitive binder by National Starch according to the sodium AMPS (2-acrylamido-2-methyl-1-propanesulfonic acid) chemistry described in commonly owned copending U.S. application Ser. No. 09/564213 by Kelly Branham et al., "Ion-Sensitive, Water-Dispersible Polymers, a Method of Making Same and Items Using Same," filed May 4, 2000, herein incorporated by reference. The SSB-6/polymer is a copolymer with a molecular weight of about 1 million and is formed from the following monomers: 60% acrylic acid, 24.5% butacrylic acid, 10.5% 2-ethylhexyl-acrylic acid, and 5% AMPS. After polymerization the AMPS is converted to its sodium salt. The SSB-6/polyvinylamine precipitate could be redissolved in copious amounts of water. On the other hand, a cationic water soluble copolymer of n-butyl acrylate and [2-(methacryloyloxy)ethyl]trimethylammonium chloride, was completely miscible with Catiofast® PR 8106. Without wishing to be bound by theory, it is believed that the amine in the polyvinylamine is acting as a proton acceptor resulting in an insoluble or poorly soluble polyelectrolyte complex with SSB-6 or the poly(methylvinylether-alt-maleic acid). Other anionic polymers such as anionic surfactants and other polymeric anionic reactive compounds are expected to form such complexes with polyvinylamines that are sufficiently hydrolyzed. The complexes can result in increased wet strength and dry strength, and can show significant synergy factors. The polyvinylamine may be present in the furnish, with the anionic compound added before or after addition of the polyvinylamine, such as topical application of an anionic compound to a web comprising polyvinylamine to increase dry and/or wet strength of the web.

Also, when mixed together, Parez 631 NC and Catiofast 8106 formed an insoluble precipitate fairly rapidly. This precipitate did not disappear after 20 minutes indicating that the reaction is irreversible in the presence of water.

Example 14

Uncreped through-air dried basesheet, equivalent to that used to produce KLEENEX-COTTONELLE® bath tissue but without strength additives, was treated with polymers, according to Table 9. Up to two polymers were applied topically by spraying the polymer solutions on the sheet and drying the sample afterwards. CDDT is the cross-direction dry tensile strength measured in grams. CDWT is the cross-direction wet strength measured after immersing the sample in hard water for 60 seconds. Sample A lacked enough wet strength to be measured. Samples B and C showed significant wet strength after one minute. Samples A and B wetted immediately, while Sample C did not wet out and appeared opaque rather than showing the translucent appearance typical of wet bath tissue. For Sample C, good wet strength appears to have been created by formation of a polyelectrolyte complex between the polyvinylamine and the SSB-6 polymer. Further wet strength testing of Sample B was done after 30 minutes of immersion in hard water, giving a value of 164. After 90 minutes, the CDWT value was 163, indicating that permanent wet strength was obtained in the hard water.

TABLE 9

Dry and Wet Strength in UCTAD Tissue.

| Sample | Polymer 1, 2% add-on | Polymer 2, 2% add-on | CDDT (g/in.) | Std. Dev. | CDWT (g/in.) (hard water) | Std. Dev. | Relative wetting |
|---|---|---|---|---|---|---|---|
| A | none | none | 211 | 19 | 0 | 0 | inst. |
| B | Catiofast 8106 | none | 459 | 35 | 44.6 | 17.8 | inst. |
| C | Catiofast 8106 | SSB-6 | 701 | 47 | 197 | 15 | did not wet |

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

What is claimed:

1. A dyed textile material comprising:

a textile material containing a cellulosic material, said cellulosic material being treated with a polyvinylamine and a complexing agent, the complexing agent serving to bond the polyvinylamine to the cellulosic material; and an acid dye applied to said cellulosic material.

2. A dyed textile material as defined in claim 1, further comprising an anionic polysiloxane, said anionic polysiloxane being bonded to said polyvinylamine.

3. A dyed textile material as defined in claim 1, wherein the complexing agent comprises a polymeric anionic reactive compound.

4. A dyed textile material as defined in claim 1, wherein the complexing agent comprises a polymeric aldehyde functional compound.

5. A dyed textile material as defined in claim 1, wherein the polyvinylamine comprises a partially hydrolyzed polyvinylformamide.

6. A dyed textile material as defined in claim 3, wherein the complexing agent comprises a polymer of a maleic anhydride or a maleic acid.

7. A dyed textile material as defined in claim 1, wherein the cellulosic material contains from about 0.5% to about 10% by weight polyvinylamine.

8. A dyed textile material as defined in claim 1, wherein the textile material is a fabric.

9. A dyed textile material as defined in claim 8, wherein the cellulosic material comprises cellulosic fibers, the textile material containing the cellulosic fibers in combination with nitrogen containing natural or synthetic fibers.

10. A dyed textile material as defined in claim 9, wherein the nitrogen containing natural or synthetic fibers comprise wool fibers or polyamide fibers.

11. A dyed textile material as defined claim 1, wherein the acid dye is an acid mordant dye.

12. A dyed textile material as defined in claim 11, wherein the mordant dye is a chrome mordant dye.

13. A dyed textile material as defined in claim 1, wherein the textile material is a yarn.

14. A dyed textile material as defined in claim 1, wherein the cellulosic material comprises cotton fibers.

15. A dyed textile material as defined in claim 1, wherein the cellulosic material comprises pulp fibers.

16. A dyed textile material as defined in claim 1, wherein the cellulosic material comprises rayon fibers.

17. A dyed textile material as defined in claim 1, wherein the textile material is a fabric and wherein the polyvinylamine is applied to the fabric according to a particular pattern.

* * * * *

UNITED STATES PATENT AND TRADEMARK OFFICE

CERTIFICATE OF CORRECTION

PATENT NO. : 7,214,633 B2
APPLICATION NO. : 10/022823
DATED : May 8, 2007
INVENTOR(S) : Tong Sun and Jeff Lindsay It is certified that error appears in the above-identified patent and that said Letters Patent is hereby corrected as shown below:

Title Page, item
(56) References Cited

U.S. PATENT DOCUMENTS
Add the following references:

| | | |
|---|---|---|
| 2,721,140 | 10/1955 | Weisgerber |
| 3,225,074 | 12/1965 | Cowen, et al. |
| 3,395,708 | 8/1968 | Hervey, et al. |
| 3,471,367 | 10/1969 | Chupka |
| 3,554,862 | 1/1971 | Hervey, et al. |
| 3,554,863 | 1/1971 | Hervey, et al. |
| 3,556,932 | 1/1971 | Coscia, et al. |
| 3,556,933 | 1/1971 | Williams, et al. |
| 3,598,696 | 8/1971 | Beck |
| 3,700,623 | 10/1972 | Keim |
| 3,772,076 | 11/1973 | Keim |
| 3,775,220 | 11/1973 | Rattray |
| 3,844,880 | 10/1974 | Meisel, Jr., et al. |
| 3,879,257 | 4/1975 | Gentile, et al. |
| 3,885,158 | 5/1975 | Flutie, et al. |
| 3,899,388 | 8/1975 | Petrovich, et al. |
| 3,916,058 | 10/1975 | Vossos, et al. |
| 3,923,593 | 12/1975 | Verseput |
| 3,972,855 | 8/1976 | Martinsson, et al. |
| 3,994,771 | 11/1976 | Morgan, Jr., et al. |
| 4,028,172 | 6/1977 | Mazzarella, et al. |
| 4,069,159 | 1/1978 | Hayek |
| 4,070,238 | 1/1978 | Wahren |
| 4,112,167 | 9/1978 | Dake, et al. |
| 4,129,528 | 12/1978 | Petrovich |
| 4,129,722 | 12/1978 | Iovine, et al. |
| 4,137,360 | 1/1979 | Reischl |
| 4,144,122 | 3/1979 | Emanuelsson, et al. |
| 4,147,586 | 4/1979 | Petrovich |
| 4,158,594 | 6/1979 | Becker, et al. |
| 4,166,001 | /1979 | Dunning |
| 4,210,489 | 7/1980 | Markofsky |
| 4,217,214 | 8/1980 | Dubin |
| 4,222,921 | 9/1980 | Van Eenam |
| 4,225,382 | 9/1980 | Kearney, et al. |

UNITED STATES PATENT AND TRADEMARK OFFICE

CERTIFICATE OF CORRECTION

PATENT NO. : 7,214,633 B2
APPLICATION NO. : 10/022823
DATED : May 8, 2007
INVENTOR(S) : Tong Sun and Jeff Lindsay It is certified that error appears in the above-identified patent and that said Letters Patent is hereby corrected as shown below:

U.S. PATENT DOCUMENTS
Add the following references: (cont'd)

| | | |
|---|---|---|
| 4,242,408 | 12/1980 | Evani, et al. |
| 4,255,294 | 3/1981 | Rudy, et al. |
| 4,255,548 | 3/1981 | Wingard, Jr., et al. |
| 4,297,860 | 11/1981 | Pacifici, et al. |
| 4,300,981 | 11/1981 | Carstens |
| 4,314,001 | 2/1982 | Wesseler |
| 4,377,543 | 3/1983 | Strolibeen, et al. |
| 4,421,602 | 12/1983 | Brunnmueller, et al. |
| 4,432,833 | 2/1984 | Breese |
| 4,440,597 | 4/1984 | Wells, et al. |
| 4,445,974 | 5/1984 | Stenberg |
| 4,482,429 | 11/1984 | Klowak |
| 4,514,345 | 4/1985 | Johnson, et al. |
| 4,528,239 | 7/1985 | Trokhan |
| 4,529,480 | 7/1985 | Trokhan |
| 4,556,450 | 12/1985 | Chuang, et al. |
| 4,654,161 | 3/1987 | Kollmeier, et al. |
| 4,684,439 | 8/1987 | Soerens |
| 4,717,498 | 1/1988 | Maxon |
| 4,773,110 | 9/1988 | Hopkins |
| 4,774,285 | 9/1988 | Pfohl, et al. |
| 4,776,965 | 10/1988 | Nuesslein, et al. |
| 4,795,530 | 1/1989 | Soerens, et al. |
| 4,808,683 | 2/1989 | Itagaki, et al. |
| 4,818,341 | 4/1989 | Degen, et al. |
| 4,880,497 | 11/1989 | Phohl, et al. |
| 4,957,977 | 9/1990 | Itagaki, et al. |
| 4,959,125 | 9/1990 | Spendel |
| 4,960,845 | 10/1990 | O'Lenick, Jr. |
| 4,978,427 | 12/1990 | Phohl, et al. |
| 5,037,560 | 8/1991 | Gayman |
| 5,048,589 | 9/1991 | Cook, et al. |
| 5,064,909 | 11/1991 | Itagaki, et al. |
| 5,070,168 | 12/1991 | O'Lenick, Jr. |
| 5,070,171 | 12/1991 | O'Lenick, Jr. |
| 5,073,619 | 12/1991 | O'Lenick, Jr. |
| 5,085,736 | 2/1992 | Bjorkquist |
| 5,098,522 | 3/1992 | Smurkoski, et al. |

UNITED STATES PATENT AND TRADEMARK OFFICE

CERTIFICATE OF CORRECTION

PATENT NO. : 7,214,633 B2
APPLICATION NO. : 10/022823
DATED : May 8, 2007
INVENTOR(S) : Tong Sun and Jeff Lindsay It is certified that error appears in the above-identified patent and that said Letters Patent is hereby corrected as shown below:

U.S. PATENT DOCUMENTS
Add the following references: (cont'd)

| | | |
|---|---|---|
| 5,098,979 | 3/1992 | O'Lenick, Jr. |
| 5,120,812 | 6/1992 | O'Lenick, Jr. et al. |
| 5,135,294 | 8/1992 | Ohshima, et al. |
| 5,149,765 | 9/1992 | O'Lenick, Jr. |
| 5,178,729 | 1/1993 | Janda |
| 5,194,263 | 3/1993 | Chamberlain,et al. |
| 5,196,499 | 3/1993 | O'Lenick, Jr. |
| 5,230,776 | 7/1993 | Andersson, et al. |
| 5,232,553 | 8/1993 | Smigo, et al. |
| 5,237,035 | 8/1993 | O'Lenick, Jr., et al. |
| 5,260,171 | 11/1993 | Smurkoski, et al. |
| 5,269,942 | 12/1993 | Harrington, IV, et al. |
| 5,275,700 | 1/1994 | Trokhan |
| 5,280,099 | 1/1994 | Imperante, et al. |
| 5,281,307 | 1/1994 | Smigo, et al. |
| 5,292,441 | 3/1994 | Chen, et al. |
| 5,296,434 | 3/1994 | Karl, et al. |
| 5,300,666 | 4/1994 | Imperante, et al. |
| 5,324,445 | 6/1994 | Langley |
| 5,328,565 | 7/1994 | Rasch, et al. |
| 5,334,289 | 8/1994 | Trokhan, et al. |
| 5,336,373 | 8/1994 | Scattolino, et al. |
| 5,353,521 | 10/1994 | Orloff |
| 5,411,636 | 5/1995 | Hermans, et al. |
| 5,431,786 | 7/1995 | Rasch, et al. |
| 5,494,554 | 2/1996 | Edwards, et al. |
| 5,496,624 | 3/1996 | Stelljes, et al. |
| 5,500,277 | 3/1996 | Trakhan, et al. |
| 5,507,914 | 4/1996 | Sarkar, et al. |
| 5,514,523 | 5/1996 | Trokhan, et al. |
| 5,522,967 | 6/1996 | Shet |
| 5,529,585 | 6/1996 | Schrell, et al. |
| 5,554,467 | 9/1996 | Trokhan, et al. |
| 5,554,469 | 9/1996 | Trokhan, et al. |
| 5,566,724 | 10/1996 | Trokhan, et al. |
| 5,598,642 | 2/1997 | Orloff, et al. |
| 5,598,643 | 2/1997 | Chuang, et al. |
| 5,614,598 | 3/1997 | Barringer Ledford |

UNITED STATES PATENT AND TRADEMARK OFFICE

CERTIFICATE OF CORRECTION

PATENT NO. : 7,214,633 B2
APPLICATION NO. : 10/022823
DATED : May 8, 2007
INVENTOR(S) : Tong Sun and Jeff Lindsay It is certified that error appears in the above-identified patent and that said Letters Patent is hereby corrected as shown below:

U.S. PATENT DOCUMENTS
Add the following references: (cont'd)

| | | |
|---|---|---|
| 5,624,790 | 4/1997 | Trokhan, et al. |
| 5,628,876 | 5/1997 | Ayers, et al. |
| 5,637,194 | 6/1997 | Ampulski, et al. |
| 5,656,132 | 8/1997 | Farrington, et al. |
| 5,667,636 | 9/1997 | Engel, et al. |
| 5,703,225 | 12/1997 | Shet, et al. |
| 5,730,839 | 3/1998 | Wendt, et al. |
| 5,772,845 | 6/1998 | Farrington, Jr., et al. |
| 5,798,078 | 8/1998 | Myers |
| 5,803,270 | 9/1998 | Brodeur |
| 5,855,739 | 1/1999 | Ampulski, et al. |
| 5,897,745 | 4/1999 | Ampulski, et al. |
| 5,932,068 | 8/1999 | Farrington, Jr., et al. |
| 5,948,507 | 9/1999 | Chen, et al. |
| 5,961,782 | 10/1999 | Luu, et al. |
| 5,962,570 | 10/1999 | Sato, et al. |
| 5,981,044 | 11/1999 | Phan ,et al. |
| 5,990,377 | 11/1999 | Chen, et al. |
| 6,010,598 | 1/2000 | Boutiller, et al. |
| 6,022,449 | 2/2000 | Jansen, et al. |
| 6,030,675 | 2/2000 | Schroeder, et al. |
| 6,096,169 | 8/2000 | Hemans, et al. |
| 6,103,060 | 8/2000 | Munerelle, et al. |
| 6,103,063 | 8/2000 | Oriaran, et al. |
| 6,143,135 | 11/2000 | Hada, et al. |
| 6,175,028 | 1/2001 | O'Lenick, Jr. |
| 6,176,973 | 1/2001 | Norlander |
| 6,200,354 | 3/2001 | Collins, et al. |
| 6,201,093 | 3/2001 | Messner, et al. |
| 6,210,528 | 4/2001 | Wolkowicz |
| 6,224,714 | 5/2001 | Schroeder, et al. |
| 6,274,667 | 8/2001 | Shannon, et al. |
| 6,306,249 | 10/2001 | Galante, et al. |

UNITED STATES PATENT AND TRADEMARK OFFICE

CERTIFICATE OF CORRECTION

PATENT NO. : 7,214,633 B2
APPLICATION NO. : 10/022823
DATED : May 8, 2007
INVENTOR(S) : Tong Sun and Jeff Lindsay It is certified that error appears in the above-identified patent and that said Letters Patent is hereby corrected as shown below:

FOREIGN PATENT DOCUMENTS
add the following references:

| | | |
|---|---|---|
| DE | 2936239 | 3/1981 |
| DE | 19713755 | 0/1989 |
| EP | 0337310 Al | 10/1989 |
| EP | 0493011 A2 | 7/1992 |
| EP | 0743172 Al | 11/1996 |
| EP | 0668245 B1 | 12/1998 |
| EP | 0743172 B1 | 4/1999 |
| EP | 0851950 B1 | 9/1999 |
| EP | 1013825 Al | 6/2000 |
| EP | 1077285 Al | 2/2001 |
| EP | 1077286 Al | 2/2001 |
| JP | 3162696 | 12/1991 |
| WO | 9727363 | 7/1997 |
| WO | 9967216 | 12/1999 |
| WO | 0009806 | 2/2000 |
| WO | 0011046 | 3/2000 |
| WO | 0034583 Al | 6/2000 |
| WO | 0043428 | 7/2000 |
| WO | 0050462 Al | 8/2000 |
| WO | 0056972 | 9/2000 |
| WO | 0101964 | 1/2001 |
| WO | 0104247 Al | 1/2001 |
| WO | 0112414 A1 | 2/2001 |
| WO | 0132974 A2 | 5/2001 |
| WO | 0134903 Al | 5/2001 |
| WO | 0135924 Al | 5/2001 |
| WO | 0141689 Al | 6/2001 |
| WO | 0145613 Al | 6/2001 |
| WO | 0149937 Al | 7/2001 |
| WO | 0183887 Al | 11/2001 |

UNITED STATES PATENT AND TRADEMARK OFFICE

CERTIFICATE OF CORRECTION

PATENT NO. : 7,214,633 B2
APPLICATION NO. : 10/022823
DATED : May 8, 2007
INVENTOR(S) : Tong Sun and Jeff Lindsay It is certified that error appears in the above-identified patent and that said Letters Patent is hereby corrected as shown below:

OTHER PUBLICATIONS
add the following references

F. Clifford, "Foam Finishing Technology: The Controlled Application of Chemicals to a Moving Substrate," Textile Chemist and Colorist, Vol. 10, No. 12, 1978, pp. 37-40
C.W, Aurich, "Uniqueness in Foam Application Processes," Tappi Nonwovens Conference, Tappi Press, Atlanta, Georgia, 1992, pp. 15-19
W. Hartmann, "Application Techniques for Foam Dyeing and Finishing," Canadian Textile Journal, April 1980, page 55
A. C. Dreshfield, "The Drying of Paper," Tappi Journal, Vol. 39, No. 7, 1956, pp. 449-455
A. A. Robertson, "The Physical Properties of Wet Webs: Part 1," Tappi Journal, Vol.42, No. 12, 1959, pp. 969-978
R. James, "Squeezing More Out of Pressing and Drying," Pulp and Paper International, Vol. 41, No. 12, December 1999, pp. 13-17
J. D. Linday, "Displacement Dewatering to Maintain Bulk," Paperi Ja Puu, Vol. 74, No. 3, 1992, pp. 232-242
M. Foulger and J. Parisian, "New Developments in Hot Pressing," Pulp and Paper Canada, Vol. 101, No. 2, Feb. 2000, pp. 47-49
P. H. Brodeur, "Acoustic Separation in a Laminar Flow," Proceeding of IEEE Ultra Sonics Symposium, Cannes, France, pp. 1359-1362 (Nov. 1994)
Young Hee Kim and Gang Sun, "Durable Antimicrobial Finishing of Nylon Fabrics with Acid Dyes and a Quatermary Ammonium Salt," Textile Research Journal, Vol. 71, No. 4, pp. 318-323, April 2001.
A. J. O'Lenick, Jr. and J. K. Parkinson, "Silicone Compounds: Not Just Oil Phase Anymore," Soap/Cosmetics/Chemical Specialties, Vol. 74, No, 6, June 1998, pp. 55-57
Annual Report 1998 Physical Chemistry - Cellulose Systems
BASF Aktiengesellschaft: Research and Development" Innovation Award 2000
C. Q. Yang, "Ftir Spectroscopy Study of Ester Crosslinking of Cotton Cellulose Catalyzed by Sodium Hypophosphite," Textile Research Journal, Vol. 71, No. 3, March 2001, pp. 201-206

UNITED STATES PATENT AND TRADEMARK OFFICE

CERTIFICATE OF CORRECTION

PATENT NO. : 7,214,633 B2
APPLICATION NO. : 10/022823
DATED : May 8, 2007
INVENTOR(S) : Tong Sun and Jeff Lindsay It is certified that error appears in the above-identified patent and that said Letters Patent is hereby corrected as shown below:

OTHER PUBLICATIONS
add the following references (cont'd)

C. Q. Yang, et al., "Nonformaldehyde Durable Press Finishing of Cotton Fabrics by Combing Polymers of Maleic Acid with Citric Acid," Textile Research Journal, Vol. 68, 1998, pp. 457-464

Signed and Sealed this

Twenty-first Day of August, 2007

JON W. DUDAS
*Director of the United States Patent and Trademark Office*